US011793375B2

(12) United States Patent
Lee et al.

(10) Patent No.: US 11,793,375 B2
(45) Date of Patent: Oct. 24, 2023

(54) CONVERSION MEMBER AND ELECTRIC CLEANER INCLUDING THE SAME

(71) Applicant: LG ELECTRONICS INC., Seoul (KR)

(72) Inventors: Sangchul Lee, Seoul (KR); Jongil Park, Seoul (KR); Seungyeop Lee, Seoul (KR); Jeongseop Park, Seoul (KR); Jaehun Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 203 days.

(21) Appl. No.: 16/868,074

(22) Filed: May 6, 2020

(65) Prior Publication Data

US 2021/0113037 A1 Apr. 22, 2021

(30) Foreign Application Priority Data

Oct. 22, 2019 (KR) ..... 10-2019-0131691

(51) Int. Cl.
*A47L 9/28* (2006.01)
*A47L 9/32* (2006.01)
(Continued)

(52) U.S. Cl.
CPC ..... *A47L 5/225* (2013.01); *A47L 5/24* (2013.01); *A47L 9/0063* (2013.01);
(Continued)

(58) Field of Classification Search
CPC ..... A47L 5/225; A47L 5/24; A47L 9/0063; A47L 9/2873; A47L 9/2894; A47L 9/322;
(Continued)

(56) References Cited

U.S. PATENT DOCUMENTS

2008/0040883 A1* 2/2008 Beskow ..... A47L 9/165 15/329
2010/0192314 A1* 8/2010 Otsuka ..... A47L 9/2884 15/3

(Continued)

FOREIGN PATENT DOCUMENTS

CN 105832246 A * 8/2016
CN 105832246 1/2019

(Continued)

OTHER PUBLICATIONS

Korean Office Action dated Jul. 1, 2021 issued in Application No. 10-2019-0131691.

(Continued)

*Primary Examiner* — Anne M Kozak
*Assistant Examiner* — Tyler James McFarland
(74) *Attorney, Agent, or Firm* — KED & ASSOCIATES, LLP

(57) ABSTRACT

Disclosed are a conversion member and an electric cleaner. The conversion member according to embodiments disclosed herein may be detachably coupled to a handle included in a main body and a pipe. Then, the main body may be connected to an intake port located at the lowest position, and the pipe may be connected to an extension handle, allowing the main body to be located at a lower position facing the intake port. Thus, the electric cleaner may have a low center of gravity. Further, when the conversion member is detached, the pipe may be located between the main body and the intake port to be connected to the main body and the intake port, respectively. Accordingly, the main body may be located at an upper position directed away from the intake port, allowing the electric cleaner to have a high center of gravity.

16 Claims, 21 Drawing Sheets

(51) Int. Cl.
*A47L 9/00* (2006.01)
*A47L 5/22* (2006.01)
*A47L 5/24* (2006.01)

(52) U.S. Cl.
CPC ..... *A47L 9/2873* (2013.01); *A47L 9/2894* (2013.01); *A47L 9/322* (2013.01)

(58) Field of Classification Search
CPC . A47L 9/32; A47L 9/242; A47L 9/248; A47L 9/28
USPC ..... 15/257.7, 328, 329, 350, 351, 405, 406, 15/422, 426, 427, 429; 16/110.1, 406, 16/422, 426
See application file for complete search history.

(56) References Cited

U.S. PATENT DOCUMENTS

| | | | | |
|---|---|---|---|---|
| 2014/0137364 | A1* | 5/2014 | Stickney | A47L 9/1683 15/347 |
| 2017/0332858 | A1* | 11/2017 | Nieschwitz | A47L 9/244 |

FOREIGN PATENT DOCUMENTS

| | | | |
|---|---|---|---|
| JP | 2005-349173 | | 12/2005 |
| JP | 2007-503932 | | 3/2007 |
| JP | 2015006040 | A * | 1/2015 |
| KR | 20-0165245 | | 2/2000 |
| KR | 20-0171783 | | 3/2000 |
| KR | 10-2014-0034662 | | 3/2014 |
| KR | 10-2016-0128111 | | 11/2016 |
| KR | 10-2019-0030486 | | 3/2019 |
| KR | 10-2018521 | | 9/2019 |
| WO | WO 2018/093086 | | 5/2018 |

OTHER PUBLICATIONS

International Search Report dated Jul. 10, 2020 issued in International Application No. PCT/KR2020/004883.
Korean Office Action dated Mar. 5, 2021 issued in Application No. 10-2019-0131691.

* cited by examiner (a)

(b)

(a)

(b)

(a)

(b)

CONVERSION MEMBER AND ELECTRIC CLEANER INCLUDING THE SAME

CROSS-REFERENCE TO RELATED APPLICATION

This application claims priority under 35 U.S.C. § 119 to Korean Application No. 10-2019-0131691 filed on Oct. 22, 2019, whose entire disclosure is hereby incorporated by reference.

BACKGROUND

1. Field

The present disclosure relates to a conversion member and an electric cleaner, and particularly, a conversion member capable of easily changing a center of mass to be at a lower or higher position by being coupled to an existing electric cleaner, and an electric cleaner including the same.

2. Background

A vacuum (or electric) cleaner is a device that causes suction to remove dust and dirt from floors or other surfaces. The vacuum cleaner has been widely used in recent years because of its convenience and efficiency compared to traditional cleaning tools such as a broom.

The vacuum cleaner requires power to drive an electric motor. Traditional vacuum cleaners, which are corded vacuum cleaners, are operated by connecting a power cord. Accordingly, after a specific room or area is cleaned, a user has to remove a plug from a socket in the area to put the plug into a socket of another area to be cleaned, causing inconvenience. Thus, a cordless vacuum cleaner powered by a battery has been in the spotlight. This cordless vacuum cleaner is recharged through a charger (or charging unit) when not in use. The user can easily detach the vacuum cleaner for cleaning.

In the conventional corded vacuum cleaner, a main body, which is the heaviest member, is located at the bottom. Accordingly, the main body has a moving member such as a wheel, so as to be moved when pulled by the user. On the other hand, in the cordless vacuum cleaner, a main body (or cleaner body), which is the heaviest member, is located at an upper or lower position.

When the main body is located at the lower side of the vacuum cleaner, a load applied to a handle, which is gripped by the user, is relatively reduced. In addition, since the entire vacuum cleaner weight is concentrated on the lower part, a size of the main body can be increased, making it suitable for cleaning floors and other surfaces.

However, due to weight of the main body located at the lower side of the vacuum cleaner, it is not easy to change a direction while moving. In addition, it is difficult to sufficiently secure a distance between the main body and an intake port through which dust is sucked.

On the other hand, when the main body is located at the upper side of the vacuum cleaner, the user can grip a handle provided adjacent to the main body. Accordingly, the user can easily lift the vacuum cleaner, making it easier to clean a gap, an upper portion of furniture, and the like. In addition, a lightweight vacuum cleaner can be achieved under the premise that the user grips and lifts the vacuum cleaner.

However, in such a vacuum cleaner, as the main body, which is the heaviest member, is located adjacent to the handle, a load on the user's wrist is increased. Also, since the center of gravity is higher, the vacuum cleaner requires a stand holder to be in an upright or standing state. Moreover, due to these limitations, a size of the main body is restricted, thereby making it difficult to secure an enough space for accommodating dust, and the like. That is, when it comes to a low center of gravity and a high center of gravity of the vacuum cleaner, they have their own advantages and disadvantages.

A first type of cleaning apparatus capable of being convertible in various types is disclosed in International Patent Publication No. WO 2018/093086 (published on May 24, 2018). In detail, the first type of cleaning apparatus is provided with an extension pipe designed to bend or fold at a predetermined angle, allowing a cleaner body to be moved to an upper position or lower position. However, this first type of cleaning device has a limitation in that the cleaner body should be located at the upper position when using the cleaning apparatus. In other words, the cleaner body can be located at the lower position only when the cleaning apparatus is not in use, and thus cleaning cannot be performed when the cleaner body is located at the lower position.

A second type of vacuum cleaner capable of performing efficient cleaning according to the use of purpose is disclosed in Korean Patent No. 10-2018521 (registered on Aug. 30, 2019). In detail, the second type of vacuum cleaner is a cordless vacuum cleaner that may be used by coupling any one of a modular cleaner body for wet vacuum cleaning, a nozzle switchable cleaner body, or a steam cleaner body to a main body of the vacuum cleaner. However, this second type of vacuum cleaner has a limitation in that the center of gravity of the vacuum cleaner cannot be changed according to the use of purpose. In more detail, as each of the modules is extended by a connecting tube or pipe, the modules are always located at the upper side of the vacuum cleaner.

That is, the above-described first and second types of vacuum cleaner do not provide a method for easily changing the vacuum cleaner's center of gravity to a lower or higher position. Furthermore, technologies proposed by the above-described first and second types of vacuum cleaner utilize a structure applied to an entire cleaning device. In other words, the user has to purchase an additional cleaning device in order to enjoy convenience provided by these technologies.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Hereinafter, a conversion member (or adapter) 500 and an electric cleaner 10 including the same will be described in detail with reference to the accompanying drawings. In the following description, a description of some components may be omitted in order to clarify the technical characteristics of the present disclosure.

The terms "front side (or part)", "rear side", "upper side", "lower side", "left side", and "right side" used in the following description will be understood with reference to a coordinate system shown in FIG. 1. For example, the term "upper side" may refer to a direction away from an intake port (unit) 300. In addition, the term "lower side" may refer to a direction toward the intake port 300.

Figure 1:
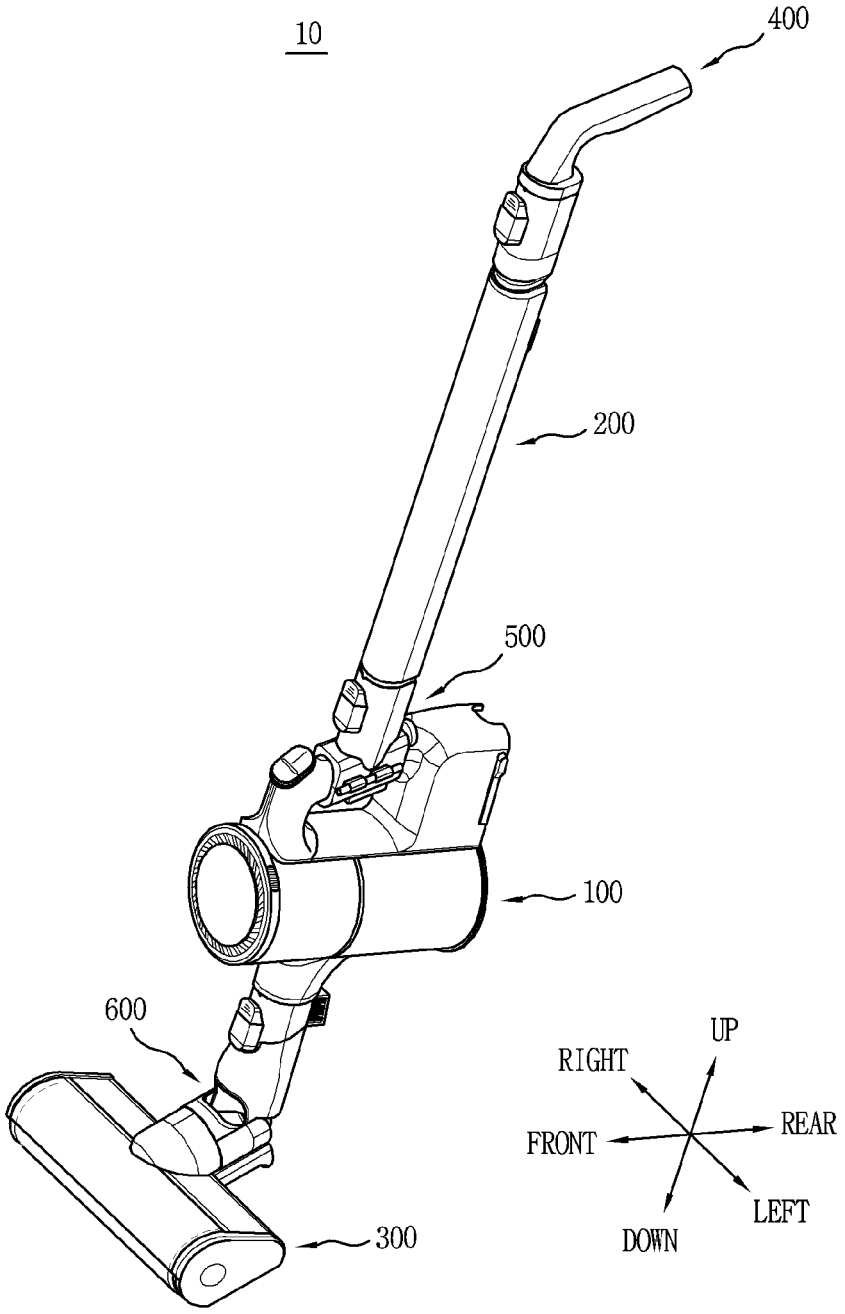
FIG. 1 is a perspective view of an electric cleaner according to an embodiment of the present disclosure.
Figure 2:
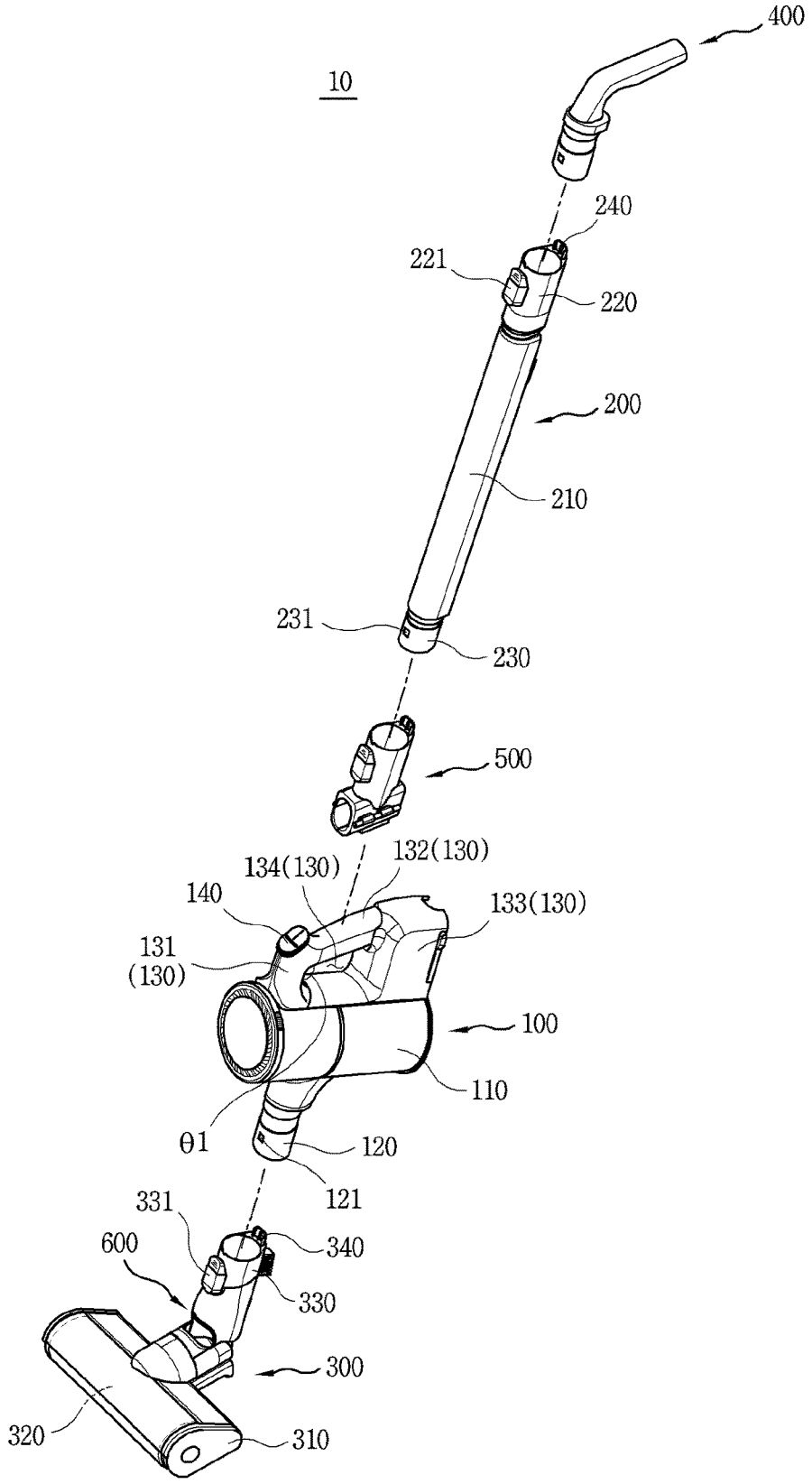
FIG. 2 is an exploded perspective view of the electric cleaner of FIG. 1.

Referring to FIGS. 1 to 2, the electric cleaner (or cleaner) 10 according an embodiment of the present disclosure may include a main body (or vacuum cleaner) 100, a pipe (or wand) 200, the intake port (or cleaner head or suction head) 300, an extension handle (or second handle) 400, the conversion member (or adapter) 500, and a joint unit (or joint) 600. Hereinafter, each of components of the electric cleaner 10 according to the embodiment of the present disclosure will be described with reference to the accompanying drawings. However, the extension handle 400, the conversion member 500, and the joint unit 600 will be described in other sections.

The main body (or hand-held cleaner) 100 may generate a suction force that causes the electric cleaner 10 to suck up dust, dirt, or the like. In addition, the main body 100 may provide a space for temporarily accommodating the sucked dust or dirt. A user may operate the main body 100 to suck up dust or dirt, and separate the main body 100 to dispose the dust or dirt collected therein.

In the illustrated embodiment, the main body 100 has a circular cross section and has a cylindrical shape extending in one direction. The main body 100 may have a shape that allows a motor unit (not shown) to be accommodated in a space formed therein, and dust, debris, or the like to be accommodated.

A predetermined space may be provided inside the main body 100. The space may be provided with the motor unit (not shown) for generating a suction force. In addition, the space may be provided with a dust container 110 in which sucked dust or dirt is collected.

The main body 100 may include a battery (not shown). Power for driving the motor unit (not shown) may be supplied from the battery (not shown). The motor unit (not shown) and the battery (not shown) may be electrically connected to each other.

The main body 100 may be detachably coupled with the pipe 200 or the intake port 300. In addition, the conversion member 500 may be detachably coupled to the main body 100. In the illustrated embodiment, the main body 100 includes the dust container 110, a main body connector 120, a handle 130, a switch 140, and a main body electric connection unit 150 (see FIGS. 9 and 10).

Dust, dirt, or the like may be collected in the dust container 110. A predetermined space may be formed inside the dust container 110. Sucked dust, dirt, or the like may be accommodated in the space. The dust container 110 may communicate with the intake port 300. Dust or dirt sucked through the intake port 300 may be introduced into the inner space of the dust container 110.

In the case of an embodiment in which the pipe 200 is located between the dust container 110 and the intake port 300 (see FIG. 14), the dust container 110 may communicate with the pipe 200. Dust or dirt may be introduced into the dust container 110 through the intake port 300 and the pipe 200.

In the illustrated embodiment, the dust container 110 has a circular cross section and has a cylindrical shape extending in one direction. The dust container 110 may be provided therein with a space and have a shape corresponding to the shape of the main body 100.

The motor unit (not shown) may be provided inside the dust container 110. As the motor unit (not shown) is connected to blades (not shown), the blades (not shown) may be rotated when the motor unit (not shown) rotates. Accordingly, a negative pressure is generated in the inner space of the dust container 110, causing dust, dirt, and the like to be sucked up.

The main body connector 120 may serve as a passage that connects the inner space of the dust container 110 and the outside. In the illustrated embodiment, the main body connector 120 is inserted into and detachably coupled to an intake connector 330 of the intake port 300. Accordingly, the inner space of the dust container 110 and the intake port 300 may communicate with each other. In the embodiment in which the dust container 110 is coupled to the pipe 200 (see FIG. 14), the main body connector 120 may be inserted into and detachably coupled to a female connector 220 of the pipe 200, thereby providing communication between the inner space of the dust container 110 and the pipe 200.

The main body connector 120 may extend from the dust container 110 to one side, namely, a lower part of the dust container 110 by a predetermined length in the illustrated embodiment. The main body connector 120 may be disposed close to one side of the dust container 110 in a lengthwise direction.

A hollow portion (not shown) may be formed inside the main body connector 120. The hollow portion (not shown) may communicate with a hollow portion (not shown)

formed in the intake connector 330, or a hollow portion (not shown) formed inside the pipe 200.

In the illustrated embodiment, the main body connector 120 has the cylindrical shape. The shape of the main body connector 120 may differ according to a shape of the intake connector 330 or the female connector 220.

The main body connector 120 may be provided therein with a diaphragm member (not shown). The diaphragm member (not shown) may open or close the hollow portion (not shown) of the main body connector 120. The hollow portion (not shown) may be opened only when a negative pressure is generated in the inner space of the dust container 110 by the motor unit (not shown).

A coupling groove 121 may be provided on an outer circumferential surface of the main body connector 120. The coupling groove 121 may be recessed from one side of the outer circumferential surface of the main body connector 120 by a predetermined distance.

When the main body connector 120 is insertedly coupled to the female connector 220, a detachment (or release) pressing portion (or button) 221 of the pipe 200 may be inserted into the coupling groove 121 in a detachable manner. The main body connector 120 and the pipe 200 may not be separated from each other unless the user presses the detachment pressing portion 221.

Likewise, when the main body connector 120 is insertedly coupled to the intake connector 330, a detachment pressing portion (or button) 331 of the intake port 300 may be detachably inserted into the coupling groove 121. The main body connector 120 and the intake port 300 may not be separated from each other unless the user presses the detachment pressing portion 331.

The handle 130 is a part or portion to which the conversion member 500 may be coupled. In the embodiment in which the main body 100 and the intake port 300 are coupled to each other, the main body 100 may be coupled with the conversion member 500.

In addition, the handle 130 is a portion through which the user grips the main body 100. In the case of the embodiment in which the main body 100 and the pipe 200 are coupled to each other (see FIG. 14), the main body 100 may be located at the uppermost part (or highest position) of the electric cleaner 10. The user may grip the electric cleaner 10 using the handle 130. The handle 130 may be located at an upper part of the dust container 110.

The handle 130 may include a first extended portion 131, a second extended portion 132, a third extended portion 133, and a space portion 134. The first extended portion 131 may extend from one side facing an upper side of the dust container 110 by a predetermined length. In the illustrated embodiment, the first extended portion 131 may be located at another side opposite to the one side where the main body connector 120 is disposed.

The first extended portion 131 may extend at a predetermined angle with respect to an outer circumferential surface of the dust container 110. In one embodiment, the angle may be 90°. The switch 140 may be located at one side, namely, an upper end of the first extended portion 131 in the illustrated embodiment.

The second extended portion 132 may be continuous with the first extended portion 131. The second extended portion 132 may extend at a predetermined angle θ1 with respect to the first extended portion 131.

The angle may be defined as an internal angle θ1 of the handle 130. In one embodiment, the internal angle θ1 of the handle 130 may be an obtuse angle. The internal angle θ1 of the handle 130 should be determined to improve grip stability for user convenience, and to reduce fatigue of the wrist even when used for a long time.

The second extended portion 132 may be spaced apart from the dust container 110 by a predetermined distance. The distance between the second extended portion 132 and the dust container 110 may be increased as the second extended portion 130 is away from the first extended portion 131.

The user may move the main body 100 by holding the second extended portion 132. In addition, the conversion member 500, which will be described hereinafter, may be detachably coupled to the second extended portion 132. A detailed description thereof will be discussed hereinafter.

The second extended portion 132 may be provided with the main body electric connection unit (or main body electric connection) 150. In detail, an upper part of the main body electric connection unit 150 may be exposed to an outside of the second extended portion 132. In one embodiment, the upper part of the main body electric connection unit 150 may be implemented as a pogo pin.

A conversion electric connection unit (or conversion electric connection) 540 provided at the conversion member 500 may be electrically connected to the upper part of the main body electric connection unit 150. In one embodiment, the conversion electric connection unit 540 may also be configured as a pogo pin. In this embodiment, the main body electric connection unit 150 and the conversion electric connection unit 540 may be electrically connected to each other in a contact manner.

The third extended portion 133 may be continuous with the second extended portion 132. The third extended portion 133 may extend at a predetermined angle with respect to the second extended portion 132. In one embodiment, the angle may be an acute angle.

The third extended portion 133 may extend to the dust container 110. That is, the third extended portion 133 may extend between one end of the second extended portion 132 and one side directed to the upper side of the dust container 110.

The third extended portion 133 may be provided with a terminal (not shown). The terminal (not shown) may be located at one side of the third extended portion 133 opposite to the second extended portion 132.

Figure 20:
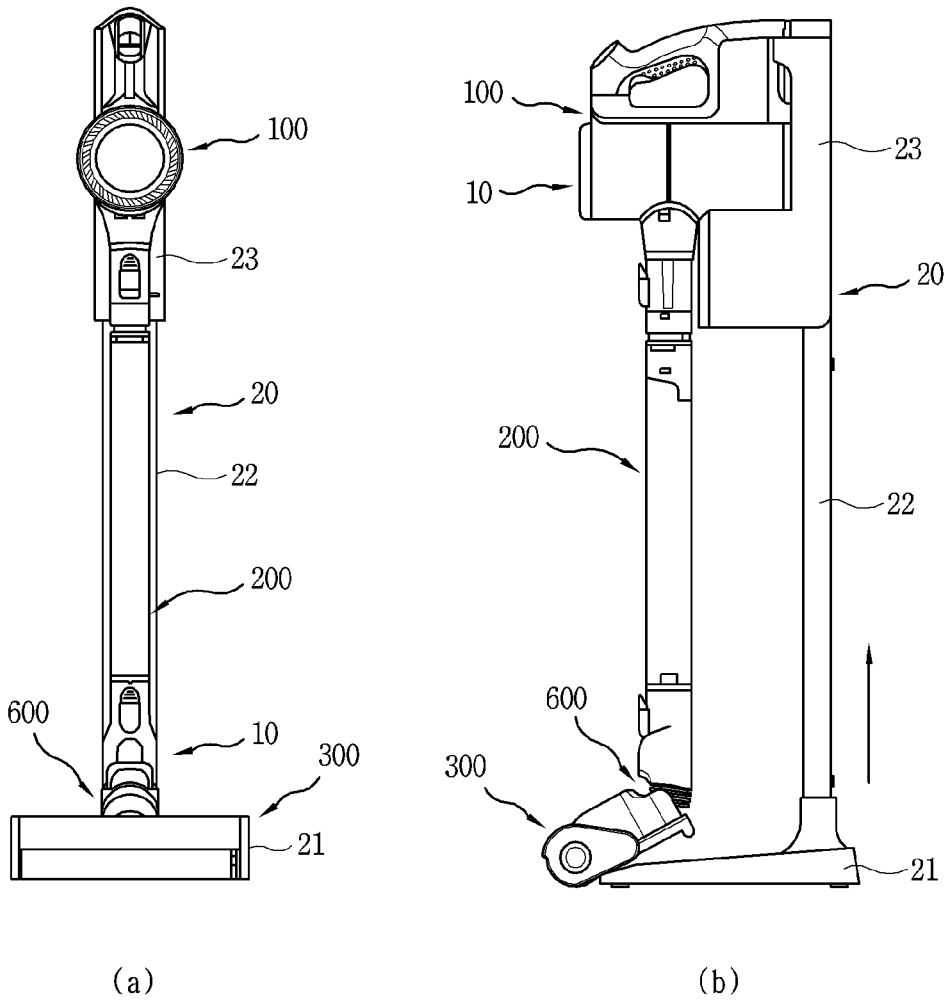
FIG. 20 is a front and lateral view, illustrating a state in which the electric cleaner of FIG. 1 with a high center of gravity is coupled to a stand holder.
Figure 21:
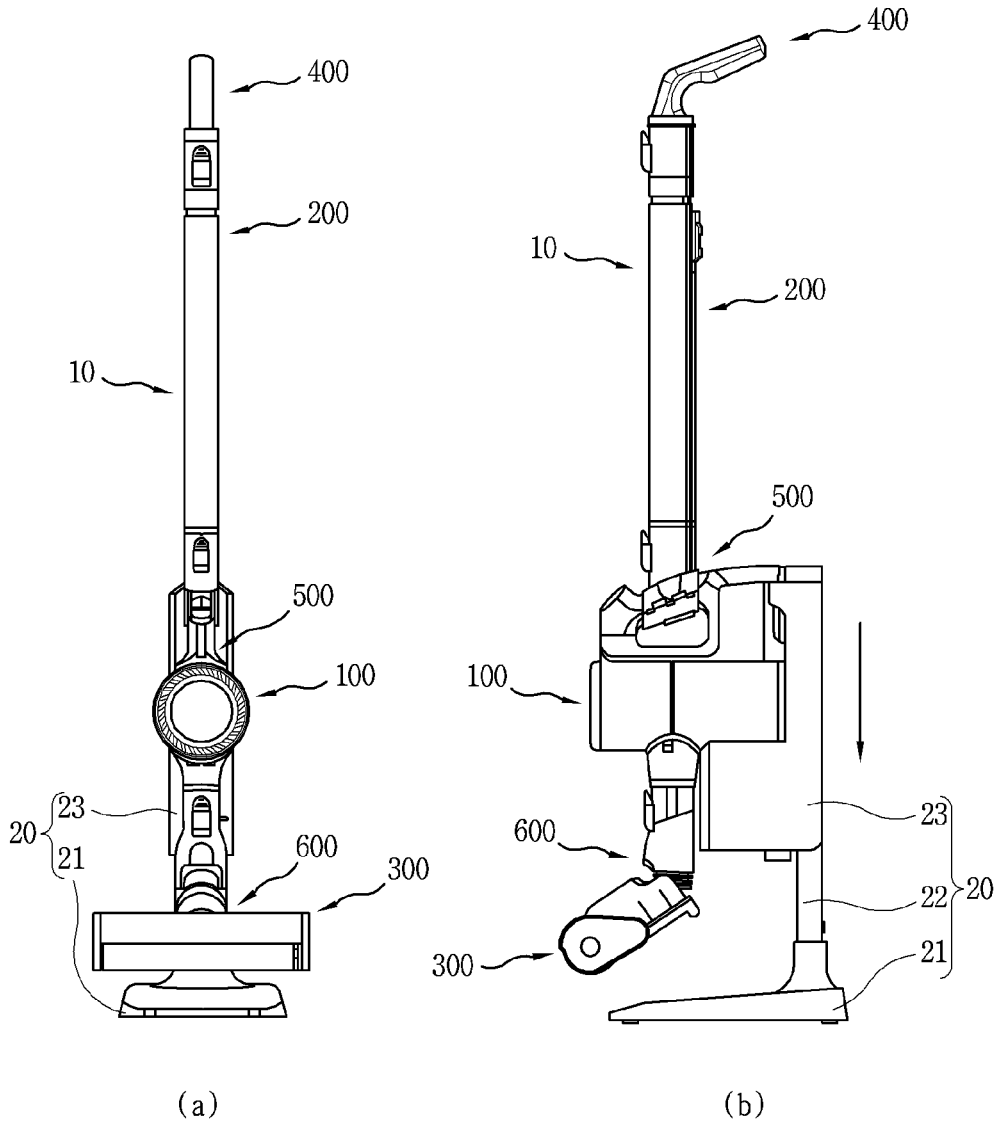
FIG. 21 is a front and lateral view, illustrating a state in which the electric cleaner of FIG. 1 with a low center of gravity is coupled to the stand holder.

When the electric cleaner 10 is placed on a stand holder 20, the terminal (not shown) may be electrically connected to a charging unit (or charger) 23 provided at the stand holder 20 (see FIGS. 20 and 21). Accordingly, a battery (not shown) electrically connected to the terminal (not shown) may be recharged.

A battery (not shown) may be accommodated in the third extended portion 133. The battery (not shown) may be electrically connected to the motor unit (not shown) and the terminal (not shown). To this end, as illustrated, the third extended portion 133 may have a greater thickness than the first extended portion 131 and the second extended portion 132.

The space portion 134 may be a space in which the user's fingers holding the second extended portion 132 are received. The space portion 134 may be defined as a space surrounded by the upper part of the dust container 110 and the first to third extended portions 131, 132, and 133. The conversion member 500 to be described hereinafter may be accommodated in the space portion 134. A detailed description thereof will be discussed later.

The switch 140 may receive a control signal for allowing the motor unit (not shown) to be driven. The user may input the control signal by pressing or touching the switch 140.

The switch 140 and the motor unit (not shown) may be electrically connected to each other.

The switch 140 may be located at the first extended portion 131. In the illustrated embodiment, the switch 140 may be located adjacent to one end of the first extended portion 131 with which the second extended portion 132 is continuous. This may allow the user to easily operate the switch 140 using his or her thumb while gripping the second extended portion 132.

The control signal applied to the switch 140 may be a specific signal for driving the motor unit (not shown). In one embodiment, the user may use the switch 140 to input a control signal related to whether the motor unit (not shown) is driven, a rotational speed of the motor unit (not shown), and the like. The control signal applied to the switch 140 may be a specific signal for operating a roller 320 of the intake port 300. In one embodiment, the user may use the switch 140 to input a control signal related to whether the roller 140 is operated, a rotational speed of the roller 320, and the like.

The main body electric connection unit 150 may provide electric connection between the main body 100 and the intake port 300. In addition, in the case of the embodiment in which the conversion member 500 is coupled to the main body 100 (see FIG. 14), the main body electric connection unit 150 may provide electric connection between the main body 100 and the conversion member 500.

The main body electric connection unit 150 may be provided in a form that allows the electric connection. In one embodiment, the main body electric connection unit 150 may be configured as a copper wire. The main body electric connection unit 150 may extend upward from a lower part of the main body 100. In addition, the main body electric connection unit 150 may be accommodated in the main body 100.

Although not shown, a lower part of the main body electric connection unit 150 may be located at the hollow portion formed inside the main body connector 120. An intake electric connection unit 340 provided at the intake port 300, or a pipe electric connection unit 240 provided at the pipe 200 may be electrically connected to the lower part of the main body electric connection unit 150. In addition, the upper part of the main body electric connection unit 150 may be located at an upper side of the second extended portion 132. The conversion electric connection unit 540 of the conversion member 500 may be electrically connected to the upper part of the main body electric connection unit 150.

When the main body connector 120 is insertedly coupled to the intake connector 330 of the intake port 300, the main body electric connection unit 150 and the intake electric connection unit 340 may be electrically connected to each other. In addition, when the main body connector 120 is insertedly coupled to the female connector 220, the main body electric connection unit 150 and the pipe electric connection unit 240 may be electrically connected to each other.

The pipe 200 may function as a passage through which dust or dirt sucked by the intake port 300 moves toward the main body 100. This function may be applied in the embodiment (see FIG. 14) in which the pipe 200 is located between the main body 100 and the intake port 300. In addition, the pipe 200 may increase an entire length of the electric cleaner 10, allowing the user to easily grip the electric cleaner 10. The function may be applied in the embodiment in which the pipe 200 is coupled to the conversion member 500 and the extension handle 400.

The pipe 200 may have a circular cross section and extend in one direction, for example, in a vertical direction in the illustrated embodiment. A cross-sectional shape of the pipe 200 may differ according to cross-sectional shapes of the main body connector 120, the intake connector 330, an extension connector 430, and a conversion connector (or collar) 510.

The pipe 200 and the main body 100 may be electrically connected to each other. A control signal applied to the main body 100 may be transmitted to the intake port 300 through the pipe 200. Accordingly, the roller 320 may be operated according to the input control signal.

The pipe 200 and the extension handle 400 may be electrically connected to each other. A control signal applied to the extension handle 400 may be transferred to the main body 100 and the intake port 300 through the pipe 200. Accordingly, the motor unit (not shown) and the roller 320 may be operated according to the input control signal.

The pipe 200 and the intake port 300 may be electrically connected to each other. A control signal applied to the main body 100 or the extension handle 400 may be transmitted to the intake port 300 through the pipe 200. Accordingly, the roller 320 may be operated according to the input control signal. The pipe 200 may be provided therein with a hollow portion (not shown). The hollow portion (not shown) may be defined as a flow path 212. Dust or dirt sucked by the intake port 300 may flow to the main body 100 through the flow path 212.

Figure 14:
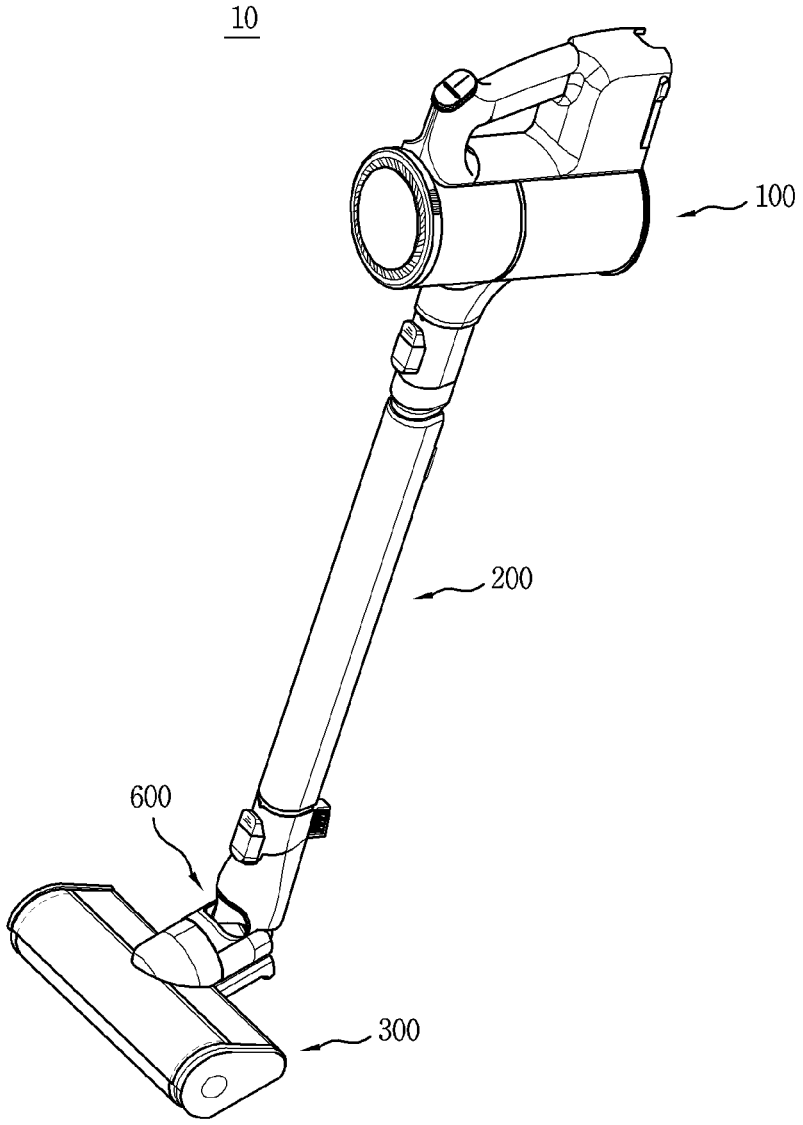
FIGS. 14 to 19 are perspective views illustrating a process in which the center of gravity of the electric cleaner of FIG. 1 is shifted to a lower position from a higher position.

The pipe 200 may be detachably coupled to the main body 100 and the intake port 300 (see FIG. 14). In addition, the pipe 200 may be detachably coupled with the extension handle 400 and the conversion member 500. In the illustrated embodiment, the pipe 200 includes an extension portion 210, the female connector 220, a male connector 230, and the pipe electric connection unit 240.

The extension portion (or tube) 210 may define the body of the pipe 200. The extension portion 210 may have a circular cross section and extend in one direction, for example, in a vertical direction in the illustrated embodiment.

The female connector 220 may be provided at one side in an extending direction of the extension portion 210, namely, an upper part of the extension portion 210 in the illustrated embodiment. The female connector 220 may be detachably coupled with the extension handle 400 or the main body 100.

The male connector 230 may be provided at another side in the extending direction of the extension portion 210, namely, a lower part of the extension portion 210 in the illustrated embodiment. The male connector 230 may be detachably coupled with the intake port 300 or the conversion member 500.

Figure 10:
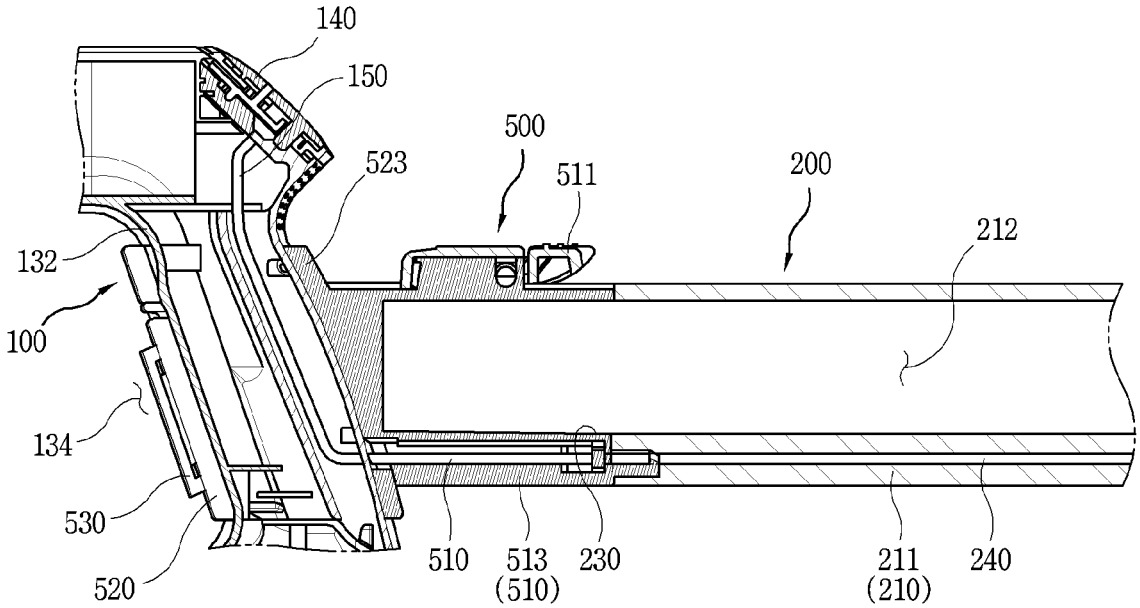
FIG. 10 is a cross-sectional view illustrating an electric connection structure between the conversion member, the main body, and a pipe included in the electric cleaner of FIG. 1.

Referring further to FIG. 10, the extension portion 210 may include a wall portion 211 and the flow path 212. The wall portion 211 may define an outer surface of the extension portion 210. The wall portion 211 may surround the flow path 212. One side of the wall portion 211 may be thicker than another side thereof. The pipe electric connection unit 240 may penetrate through the one side of the wall portion 211.

The flow path 212 is a passage through which dust or dirt sucked by the intake port 300 is moved. The flow path 212 may be defined as a hollow portion surrounded by the wall portion 211. The flow path 212 may extend in a direction in which the extension portion 210 extends. That is, the flow path 212 may penetrate through the extension portion 210 in a lengthwise direction. The flow path 212 may communicate with a hollow portion formed inside the female connector 220 and a hollow portion formed inside the male connector 230.

The main body connector 120 of the main body 100 or the extension connector 430 of the extension handle 400 may be detachably inserted into the female connector 220. It will be understood that the name or designation of the female connector 220 is derived from this coupling or connection scheme.

In the illustrated embodiment, the female connector 220 is located at the upper part of the extension portion 210. The female connector 220 may be provided at a suitable position to be coupled with the main body connector 120 or the extension connector 430.

The female connector 220 may extend from the upper part of the extension portion 210 by a predetermined length. An extended length of the female connector 220 may differ according to an extended length of the main body connector 120 or the extension connector 430.

The female connector 220 may be provided therein with a hollow portion. The hollow portion may communicate with the flow path 212. In addition, the hollow portion may communicate with the hollow portion of the main body connector 120 or a hollow portion 432 of the extension connector 430.

The female connector 220 may include the detachment pressing portion (or button) 221. The detachment pressing portion 221 may be detachably inserted into the coupling groove 121 of the main body connector 120 or a groove 431 of the extension handle 400.

Once the detachment pressing portion 221 is insertedly coupled to the coupling groove 121 or the groove 431, the detachment pressing portion 221 may not be separated unless pressed by the user. This may allow the pipe 200 and the main body 100 or the extension handle 400 to be securely coupled to each other.

The male connector 230 may be inserted into and detachably coupled to the intake connector 330 of the intake port 300 or the conversion connector 510 of the conversion member 500. It will be understood that the name or designation of the male connector 230 is derived from this coupling or connection scheme.

In the illustrated embodiment, the male connector 230 is located at the lower part of the extension portion 210. The male connector 230 may be provided at a suitable position to be coupled with the intake connector 330 or the conversion connector 510.

The male connector 230 may extend from the lower part of the extension portion 210 by a predetermined length. An extended length of the male connector 230 may differ according to an extended length of the intake connector 330 or the conversion connector 510.

The male connector 230 may be provided therein with a hollow portion. The hollow portion may communicate with the flow path 212. In addition, the hollow portion may communicate with the hollow portion of the intake connector 330 or a hollow portion of the conversion connector 510.

The male connector 230 may include a coupling groove 231. The coupling groove 231 may be recessed from one side of an outer circumferential surface of the male connector 230 by a predetermined distance. The detachment pressing portion 331 of the intake connector 330 or a detachment pressing portion 511 of the conversion connector 510 may be detachably inserted into the coupling groove 231.

Once the detachment pressing portion 331 or the detachment pressing portion 511 is insertedely coupled to the coupling groove 231, this coupled state may be securely maintained, and thus they may not be separated from each other unless the user presses the detachment pressing portion 331 or the detachment pressing portion 511. Accordingly, the pipe 200 and the intake port 300, or the pipe 200 and the conversion member 500 may be securely coupled to each other.

The pipe electric connection unit 240 may electrically connect the pipe 200 with the main body 100, the intake port 300, the extension handle 400, and the conversion member 500. In addition, in the embodiment in which the pipe 200 is connected to the main body 100 and the intake port 300 (see FIG. 14), the pipe electric connection unit 240 may electrically connect the pipe 200 with the main body 100 and the intake port 300.

The pipe electric connection unit 240 may be provided in a form that allows the electric connection. In one embodiment, the pipe electric connection unit 240 may be configured as a copper wire. The pipe electric connection unit 240 may be inserted into one side of the wall portion 211 of the extension portion 210 in a penetrating manner. The pipe electric connection unit 240 may extend upward from the lower part of the extension portion 210.

In detail, a lower part of the pipe electric connection unit 240 may be located at a space recessed from a lower end of the extension portion 210 by a predetermined distance. The intake electric connection unit 340 or the conversion electric connection unit 540 may be electrically connected to the lower part of the pipe electric connection unit 240.

In addition, an upper part of the pipe electric connection unit 240 may protrude from an upper end of the extension portion 210 by a predetermined length. The upper part of the pipe electric connection unit 240 may be electrically connected to the main body electric connection unit 150 or an extension electric connection unit 450.

When the main body connector 120 is insertedly coupled to the female connector 220, the pipe electric connection unit 240 and the main body electric connection unit 150 may be electrically connected to each other. When the extension handle 400 is insertedly coupled to the female connector 220, the pipe electric connection unit 240 and the extension electric connection unit 450 may be electrically connected to each other.

The intake port 300 is a part or portion into which dust or dirt is sucked by a negative pressure generated when the motor unit (not shown) of the main body 100 is operated. In addition, the intake port 300 may collect dust or dirt as the roller 320 moves in a rotating manner.

The intake port 300 may be located at the lowermost part (or lowest position) of the electric cleaner 10. This location may be used because the intake port 300 is a portion that is in direct contact with surfaces (or ground) or indoor floors.

The intake port 300 may be detachably connected to the main body 100. The intake port 300 may communicate with the dust container 110 of the main body 100. Dust or dirt sucked through the intake port 300 may move to the inner space of the dust container 110.

The intake port 300 and the main body 100 may be electrically connected to each other. Power for operating the intake port 300 may be transmitted from the battery (not shown) of the main body 100. In addition, a control signal applied through the switch 140 may be transmitted to the roller 320, allowing the roller 320 to be operated.

The intake port 300 may have a shape that allows the intake port 300 to be in contact with a large area of the floor. The intake port 300 may include a housing 310, the roller 320, the intake connector 330, and the intake electric connection unit 340. In addition, the intake port 300 may be provided with the joint unit 600 for adjusting an angle between the housing 310 and the intake connector 330. Detailed description of the joint unit 600 will be discussed hereinafter.

The housing 310 may define the body of the intake port 300. The roller 320 may be provided in housing 310. In addition, one side of the housing 310 may be connected to the joint unit 600 to which the intake connector 330 is connected.

The housing 310 may extend in one direction, for example, in a widthwise direction by a predetermined length in the illustrated embodiment. That is, when viewed from the above, the housing 310 may have a rectangular shape having its horizontal dimension (left-right direction) is longer than a vertical dimension (front-rear direction). This shape may increase an area that comes in contact with the intake port 300 per each time when the intake port 300 passes over the floor.

A predetermined space may be provided inside the housing 310. The roller 320 may be rotatably disposed in the space. The space may communicate with the intake connector 330. Dust, dirt, or the like introduced into the space may flow to the main body 100 or the pipe 200 through the intake connector 330.

An opening portion may be provided at a lower part of the housing 310. The roller 320 accommodated in the space may be in contact with the floor through the opening portion. As the intake port 300 moves, the roller 320 may move while rolling, so as to suck up dust, dirt, and the like from the floor. The roller 320 may be rotatably connected to the housing 310.

The roller 320 may be accommodated in the inner space of the housing 310. In addition, the roller 320 may be partially in contact with the floor through the opening portion formed at the lower part of the housing 310. The dust or dirt collected while the roller 320 is rolling may flow to the main body 100 together with dust or dirt sucked by a negative pressure generated by the motor unit (not shown).

The intake connector 330 may serve as a passage through which the collected or sucked dust or dirt is moved from the inner space of the housing 310 to the main body 100. The main body connector 120 or the male connector 230 may be inserted into and detachably coupled to the intake connector 330.

In the illustrated embodiment, the intake connector 330 may be coupled to the housing 310 so as to face the roller 320. The intake connector 330 may be provided at a suitable position to be coupled with the main body connector 120 or the male connector 230.

The intake connector 330 may extend from the housing 310 by a predetermined length. An extended length of the intake connector 330 may differ according to an extended length of the main body connector 120 or the male connector 230.

The intake connector 330 may be provided therein with a hollow portion. The hollow portion may communicate with the inner space of the housing 310. Dust or dirt collected or sucked into the inner space of the housing 310 may be moved to the hollow portion. In addition, the hollow portion may communicate with the hollow portion of the main body connector 120 or the hollow portion of the male connector 230.

The joint unit 600 may be located between the intake connector 330 and the housing 310. An angle between the intake connector 330 and the housing 310 may be changed by the joint unit 600. A detailed description thereof will be discussed later.

The intake connector 330 may include the detachment pressing portion (or button) 331. The detachment pressing portion 331 may be inserted into and detachably coupled to the coupling groove 121 of the main body connector 120 or the coupling groove 231 of the male connector 230.

Once the detachment pressing portion 331 is insertedly coupled to the coupling groove 121 or the coupling groove 231, they may not be separated from each other unless the user presses the detachment pressing portion 331. This may allow the intake port 300 and the main body 100 or the pipe 200 to be securely coupled to each other.

The intake electric connection unit 340 may provide electric connection between the intake port 300 and the main body 100. In addition, in the embodiment in which the pipe 200 is connected to the intake port 300 (see FIG. 14), the intake electric connection unit 340 may provide electric connection between the intake port 300 and the pipe 200.

The intake electric connection unit 340 may be provided in a form that allows the electric connection. In one embodiment, the intake electric connection unit 340 may be implemented as a copper wire.

The intake electric connection unit 340 and the roller 320 may be electrically connected to each other. A control signal and power applied from the main body 100 may be transmitted to the roller 320 through the intake electric connection unit 340.

The intake electric connection unit 340 may extend upward from the intake connector 330 by a predetermined distance. When the main body connector 120 is insertedly coupled to the intake connector 330, the intake electric connection unit 340 and the main body electric connection unit 150 may be electrically connected to each other. When the male connector 230 is insertedly coupled to the intake connector 330, the intake electric connection unit 340 and the pipe electric connection unit 240 may be electrically connected to each other.

Referring to FIGS. 1 to 2, the electric cleaner 10 according to the embodiment of the present disclosure may include the extension handle 400. The extension handle 400 may be located at the uppermost part (or highest position) of the electric cleaner 10. That is, the extension handle 400 may be located farthest from the intake port 300.

As for the embodiment in which the main body 100 and the intake port 300 are directly coupled to each other, the extension handle 400 may serve as a grip grasped or gripped by the user. In one embodiment, the user may apply a control signal for controlling operation of the electric cleaner 10 by using the extension handle 400.

Figure 3:
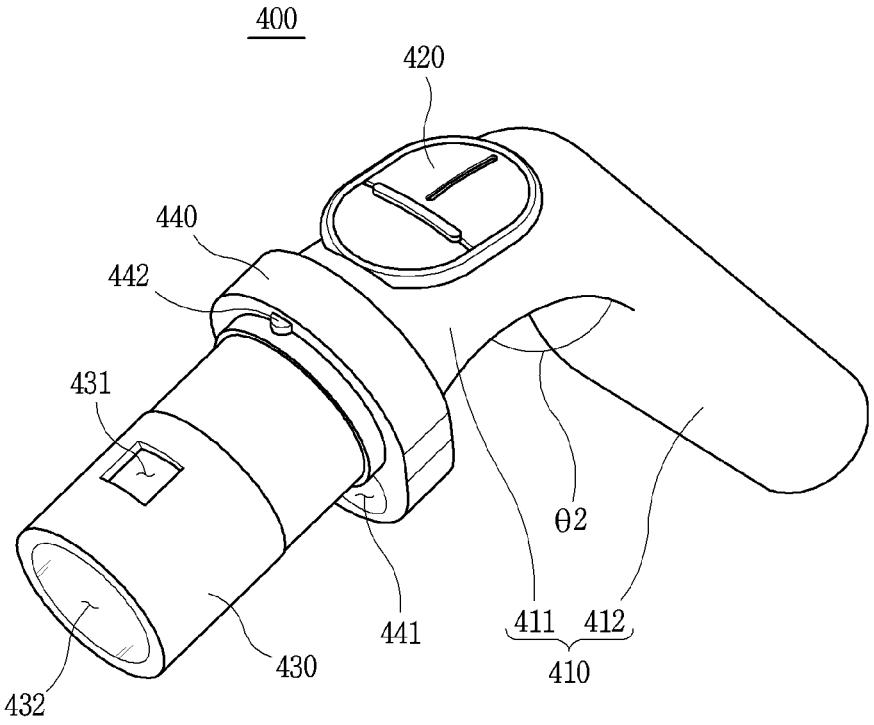
FIG. 3 is a perspective view of an extension handle included in the electric cleaner of FIG. 1.
Figure 4:
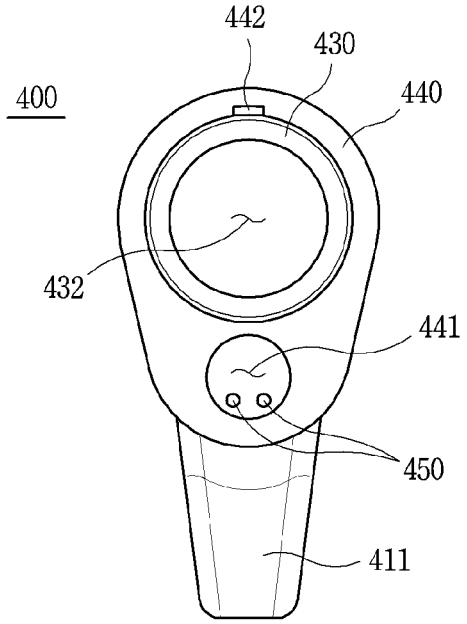
FIG. 4 is a front and lateral view of the extension handle of FIG. 3.
Figure 4:
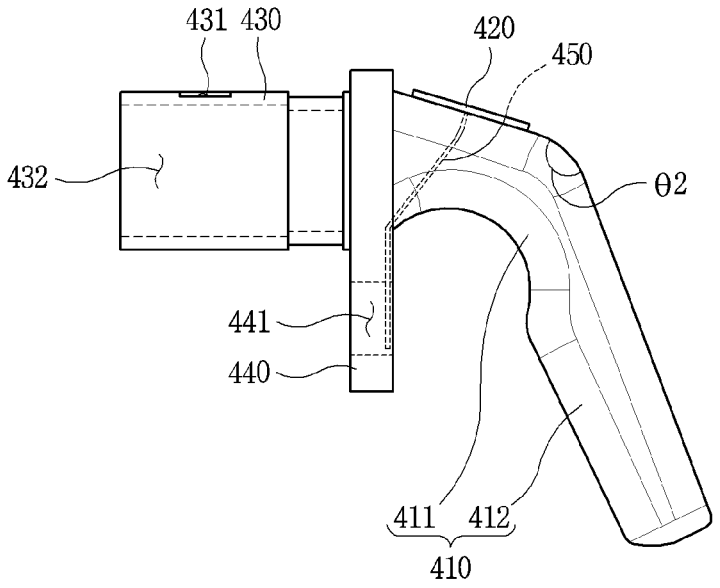

Hereinafter, the extension handle 400 according to an embodiment of the present disclosure will be described in detail with reference to FIGS. 3 to 4. The extension handle 400 may be detachably coupled to the pipe 200, which may be achieved by coupling of the female connector 220 and the extension connector 430. The extension handle 400 and the pipe 200 may be electrically connected to each other, which may be achieved by the extension electric connection unit 450 and the pipe electric connection unit 240.

In the illustrated embodiment, the extension handle 400 includes a grip portion 410, an extension switch 420, the extension connector 430, a boss portion 440, and the extension electric connection unit 450. The grip portion 410 may be a portion of the extension handle 400 designed to be gripped by the user. The grip portion 410 may include a first portion 411 and a second portion 412.

The first portion 411 may extend from the boss portion 440. The first portion 411 may extend at a predetermined angle with respect to the pipe 200. In one embodiment, the first portion 411 may extend in parallel with the pipe 200. In another embodiment, the first portion 411 may extend to have a same central axis as the pipe 200.

One side of the first portion 411, namely, a lower end of the first portion 411 may be connected to the boss portion 440 in the illustrated embodiment. Another side of the first portion 411, for example, an upper end the first portion 411 may be connected to the second portion 412 in the illustrated embodiment.

The extension switch 420 may be provided on one another side of the first portion 411. The extension switch 420 may be located in a direction opposite to an extending direction of the second portion 412.

The second portion 412 may be a portion of the extension handle 400 designed to be gripped by the user. The second portion 412 may extend from an end of the another side of the first portion 411. The second portion 412 may extend at a predetermined angle θ2 with respect to the first portion 411. The predetermined angle θ2 may be defined as an internal angle θ2 of the grip portion 410. In one embodiment, the internal angle θ2 of the grip portion 410 may be an obtuse angle.

In one embodiment, the internal angle θ2 of the grip portion 410 may be determined within a range of 90% to 110% of the internal angle θ1 of the handle 130. In addition, the internal angle θ2 of the grip portion 410 may be equal to the internal angle θ1 of the handle 130.

In this embodiment, the user who grips the extension handle 400 may feel the same sense of grip as when grasping the handle 130 of the main body 100. Accordingly, even if the extension handle 400 is provided, the user may perform cleaning without any uncomfortable or awkward feeling compared when using the existing electric cleaner 10. It will be understood that the range of 90% to 110% is a numerical range that may give almost the same sense of grip to the user. In one embodiment, the grip portion 410 may be made of the same material as the handle 130.

The extension switch 420 may receive power and a control signal for controlling the main body 100 or the intake port 300, so that the user holding the extension handle 400 controls the intake port 300. The extension switch 420 and the extension electric connection unit 450 may be electrically connected to each other. This may allow the extension switch 420 to be electrically connected with the main body 100, the pipe 200, the intake port 300, and the conversion member 500.

In the illustrated embodiment, the extension switch 420 is located adjacent to one end of the first portion 411 to which the first portion 411 and the second portion 412 are connected. Accordingly, the user may manipulate the extension switch 420 by using his or her thumb while grasping the second portion 412 by a hand.

The extension connector 430 may be a portion through which the extension handle 400 and the pipe 200 are connected. The extension connector 430 may be located opposite to the grip portion 410 based on the boss portion 440. In the illustrated embodiment, the extension connector 430 is located at a lower side of the boss portion 440.

The extension connector 430 may extend from the boss portion 440 by a predetermined length. An extended length of the extension connector 430 may differ according to a length of the hollow portion formed inside the female connector 220.

The extension connector 430 may be inserted into and detachably coupled to the female connector 220 of the pipe 200. When the extension connector 430 is insertedly coupled to the female connector 220, the extension electric connection unit 450 and the pipe electric connection unit 240 may be electrically connected to each other.

In the illustrated embodiment, the extension connector 430 may have a cylindrical shape with the hollow portion 432 formed therein. The shape of the extension connector 430 may differ according to a shape of the hollow portion formed inside the female connector 220.

The extension connector 430 may include the groove 431. The groove 431 may be recessed from one side of an outer circumferential surface of the extension connector 430 by a predetermined distance. In the illustrated embodiment, the groove 431 may be formed on one side at which the extension switch 420 is provided.

The detachment pressing portion 221 of the female connector 220 may be inserted into and detachably coupled to the groove 431. Once the detachment pressing portion 221 is insertedly coupled to the groove 431, they may not be separated from each other unless the user presses the detachment pressing portion 221. This may allow the extension handle 400 and the pipe 200 to be securely coupled to each other.

The boss portion (or boss) 440 may be located between the grip portion 410 and the extension connector 430. The boss portion 440 may limit an insertion length of the extension connector 430 to be inserted into the female connector 220. In addition, the boss portion 440 may prevent the user's hand from sliding further downwards over the grip portion 410 when the user grips the extension handle 400.

The grip portion 410 may be located at an upper part of the boss portion 440. The grip portion 410 may include the first portion 411 extending from one surface of the upper part of the boss portion 440 by a predetermined distance. The extension connector 430 may be located at a lower part of the boss portion 440. The extension connector 430 may extend from one surface of the lower part of the boss portion 440 by a predetermined distance.

In the illustrated embodiment, the boss portion 440 has a circular cross section and has a cylindrical shape with a predetermined height. The boss portion 440 may have other shapes if the above-described function is achieved. The boss portion 440 may include an insertion space 441 and a protrusion 442.

The insertion space 441 may be a space in which the upper part of the pipe electric connection unit 240 is inserted. The insertion space 441 may be recessed from one surface of the lower part of the boss portion 440 by a predetermined distance.

In the illustrated embodiment, the insertion space 441 is located away from the extension switch 420. A position of the insertion space 441 may be changed according to a relative position between the extension portion 210 of the pipe 200 and the pipe electric connection unit 240.

A lower part of the extension electric connection unit 450 may be located inside the insertion space 441. The lower part of the extension electric connection unit 450 may be electrically connected to the upper part of the pipe electric connection unit 240 that is insertedly coupled to the insertion space 441.

The protrusion 442 may constrain a coupling direction of the extension handle 400 and the pipe 200. When the extension handle 400 and the pipe 200 are coupled to each other, the protrusion 442 may be slidingly inserted into a fastening groove (not shown) formed in an outer circumferential surface of the female connector 220. Accordingly, the extension handle 400 may not be rotated after the extension handle 400 and the pipe 200 are coupled to each other.

The protrusion 442 may protrude from a lower surface of the boss portion 440 by a predetermined length. The protruding length of the protrusion 442 may be determined according to a length of the fastening groove (not shown).

The extension electric connection unit 450 may provide electric connection between the extension handle 400 and the pipe 200. As described above, the pipe 200 and the conversion member 500 may be electrically connected to each other. As will be described later, the conversion member 500 and the main body 100 may be electrically connected to each other, and the main body 100 and the intake port 300 may be electrically connected to each other. Accordingly, the extension handle 400 may be electrically connected with the main body 100, the pipe 200, the intake port 300, and the conversion member 500.

The extension electric connection unit 450 may be provided in a form that allows this electric connection. In one embodiment, the extension electric connection unit 450 may be configured as a copper wire.

An upper part of the extension electric connection unit 450 may be electrically connected to the extension switch 420. Power and a control signal applied to the extension switch 420 by the user may be transmitted to the extension electric connection unit 450.

A lower part of the extension electric connection unit 450 may be located inside the insertion space 441. The lower part of the electric connection unit 450 may be electrically connected to the pipe electric connection unit 240 that is inserted into the insertion space 441. The power and control signal transmitted to the extension electric connection unit 450 may be transferred to the pipe electric connection unit 240.

The electric cleaner 10 according to the embodiment of the present disclosure may include the conversion member 500. The conversion member 500 may be detachably coupled to the main body 100 and the pipe 200, respectively. The conversion member 500 may allow the main body 100 to be located at an upper or lower position of the electric cleaner 10. That is, as the conversion member 500 connects the main body 100 and the pipe 200, the user may conveniently use the electric cleaner 10 even when the main body 100 is located relatively low.

Hereinafter, the conversion member 500 according to embodiments of the present disclosure will be described in detail with reference to FIGS. 5 to 10. In the illustrated embodiments, a lower part of the conversion member 500 may be detachably coupled to the handle 130 of the main body 100. In addition, an upper part of the conversion member 500 may be detachably coupled to the male connector 230 of the pipe 200.

In the illustrated embodiments, the conversion member 500 includes the conversion connector (or collar) 510, a coupling unit (or clamp) 520, a fastening portion (or latch) 530, and the conversion electric connection unit (electric connector) 540. The conversion connector 510 may define the body of the conversion member 500. In addition, the conversion connector 510 is a part or portion to which the pipe 200 is detachably coupled. In detail, the male connector 230 of the pipe 200 may be inserted into and detachably coupled to the conversion connector 510.

The conversion connector 510 may be located at one side, namely, an upper part of the coupling unit 520 in the illustrated embodiment. The conversion connector 510 may extend upward from one upper surface of the coupling unit 520 by a predetermined length. The extended length of the conversion connector 510 may differ according to the extended length of the male connector 230. A hollow portion may be formed inside the conversion connector 510. The hollow portion may communicate with the hollow portion provided inside the male connector 230.

In the illustrated embodiments, the conversion connector 510 may include the detachment pressing portion 511, a through hole (portion) 512, and a wall portion 513. The detachment pressing portion 511 may be inserted into and detachably coupled to the coupling groove 231 formed on the male connector 230. When the male connector 230 is insertedly coupled to the conversion connector 510, the detachment pressing portion 511 may be insertedly coupled to the coupling groove 231.

Once the detachment pressing portion 511 is insertedly coupled to the coupling groove 231, they may not be separated from each other unless the user presses the detachment pressing portion 511. This may allow the conversion member 500 and the pipe 200 to be securely coupled to each other.

In one embodiment, the detachment pressing portions 221, 331, and 511 may be configured to have the same structure. Similarly, the coupling grooves 121 and 231 may be configured to have the same structure.

Figure 9:
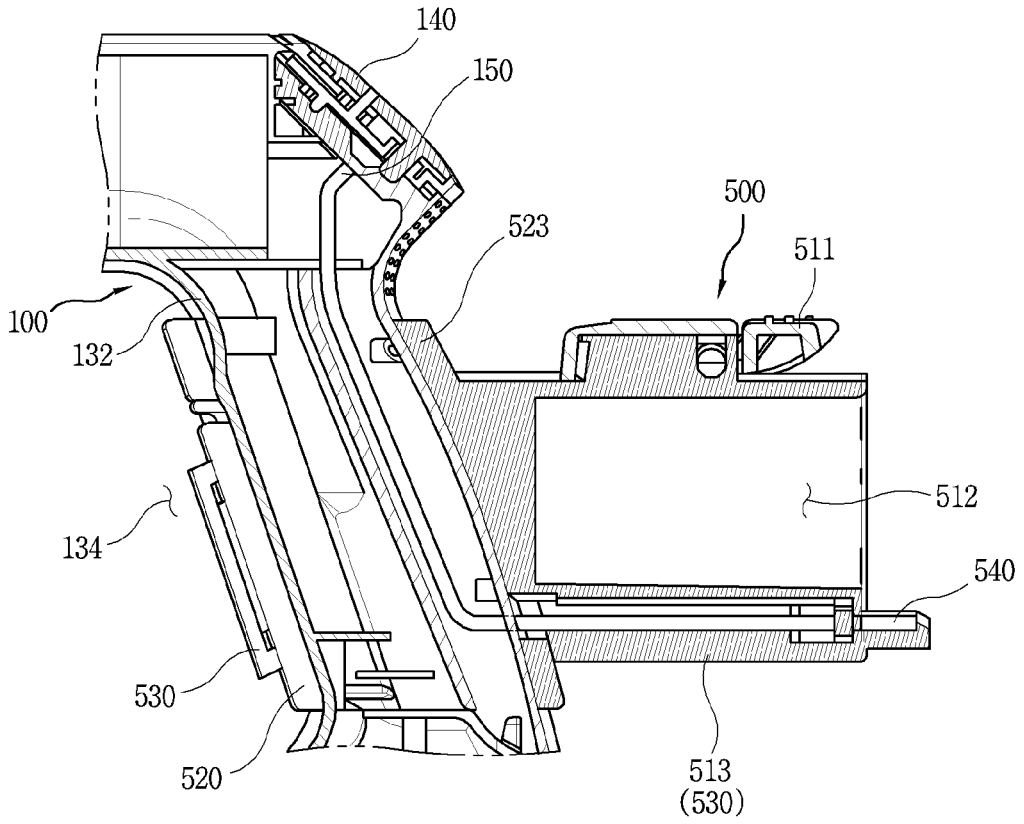
FIG. 9 is a cross-sectional view illustrating an electric connection structure between the conversion member and a main body included in the electric cleaner of FIG. 1.

The through hole 512 may be formed in the conversion connector 510 (see FIG. 9). The through hole 512 may be recessed from one side, namely, an upper end of the conversion connector 510 by a predetermined distance in the illustrated embodiments.

The male connector 230 may be detachably inserted into the through hole 512. A shape of the through hole 512, namely, a cross-sectional shape and the recessed distance may be determined according to a shape of the male connector 230.

The wall portion 513 may form a boundary of the conversion connector 510. The wall portion 513 may allow the through hole 512 to be physically apart from the outside. The wall portion 513 may surround the through hole 512. That is, the through hole 512 may be a space surrounded by the wall portion 513.

The wall portion 513 may extend in one direction, for example, in a vertical direction (or up-and-down direction) in the illustrated embodiments. Accordingly, the through hole 512, which is a space surrounded by the wall portion 513, may also extend in the vertical direction.

One side of the wall portion 513 may protrude toward the through hole 512 by a predetermined length. The conversion electric connection unit 540 may be accommodated in the protruding portion. The conversion electric connection unit 540 may extend along the one direction in which the wall portion 513 extends.

The coupling unit 520 may be a part or portion through which the conversion member 500 and the main body 100 are detachably coupled. In detail, the coupling unit 520 may be detachably coupled to the second extended portion 132 of the main body 100.

The coupling unit 520 may be located at one side of the conversion connector 510, namely, a lower part of the conversion connector 510 in the illustrated embodiments. The coupling unit 520 may be provided with a space. The second extended portion 132 of the main body 100 may be accommodated in the space.

In the illustrated embodiments, the coupling unit 520 may include a first coupling portion (or second wall) 521, a second coupling portion (or second wall) 522, a connecting portion (or first wall) 523, a first hinge part 524, (or first hinge) and a second hinge part (or second hinge) 525, a slip prevention portion (or slip prevention layer) 526, and a penetrating portion (or slot) 527.

The first coupling portion 521 together with the second coupling portion 522 may be detachably coupled to the second extended portion 132 of the handle 130. The first coupling portion 521 may be aligned with the second coupling portion 522. The first coupling portion 521 may be disposed to face the second coupling portion 522.

One side of the first coupling portion 521, namely, an upper end of the first coupling portion 521 may be connected to the first hinge part 524 in the illustrated embodiments. In addition, the first hinge part 524 may be connected to one side of the connecting portion 523, for example, a front side of the connecting portion 523 in the illustrated embodiments. The first hinge part 524 may allow the first coupling portion 521 to be rotatably connected to the connecting portion 523.

In the illustrated embodiments, the first coupling portion 521 may have a rounded shape, which is convex outwardly. That is, one side of the first coupling portion 521 that faces the second coupling portion 522 may be rounded in a direction away from the second coupling portion 522.

Accordingly, a predetermined space may be formed in an inside of the first coupling portion 521. The second extended portion 132 may be partially accommodated in the space. A curvature of the first coupling portion 521 with the rounded shape may be determined according to a curvature of the second extended portion 132. The slip prevention portion 526 may be provided on an inner surface of the first coupling portion 521.

The penetrating portion 527 may partially penetrate through one side, of the first coupling portion 521, namely, a lower part of the first coupling portion 521 in the illustrated embodiments. In addition, a female fastening portion (or latch) 531 of the fastening portion 530 may be rotatably coupled to the one side of the first coupling portion 521.

The second coupling portion 522 together with the first coupling portion 521 may be detachably coupled to the second extended portion 132 of the handle 130. The second coupling portion 522 may be aligned with the first coupling portion 521. The second coupling portion 522 may be disposed to face the first coupling portion 521.

One side of the second coupling portion 522, namely, an upper end of the second coupling portion 522 may be connected to the second hinge part 525 in the illustrated embodiments. In addition, the second hinge part 525 may be connected to one side, for example, a front side of the connecting portion 523 in the illustrated embodiments. The second hinge part 525 may allow the second coupling portion 522 to be rotatably connected to the connecting portion 523.

In the illustrated embodiments, the second coupling portion 522 may have a rounded shape, which is convex outwardly. That is, one side of the second coupling portion 522 that faces the first coupling portion 521 may be rounded in a direction away from the first coupling portion 521.

Accordingly, a predetermined space may be formed in an inside of the second coupling portion 522. The second extended portion 132 may be partially accommodated in the space. A curvature of the second coupling portion 522 with the rounded shape may be determined according to the curvature of the second extended portion 132. In an embodiment in which the second extended portion 132 has a symmetric cross section, the first coupling portion 521 and the second coupling portion 522 may have the same curvature.

The penetrating portion 527 may be partially formed through one side of the second coupling portion 522, namely, a lower part of the second coupling portion 522 in the illustrated embodiments. In addition, a male fastening portion (or catch) 532 of the fastening portion 530 may protrude from the one side of the second coupling portion 522. The slip prevention portion 526 may be provided on a surface of the inner side of the second coupling portion 522.

Figure 5:
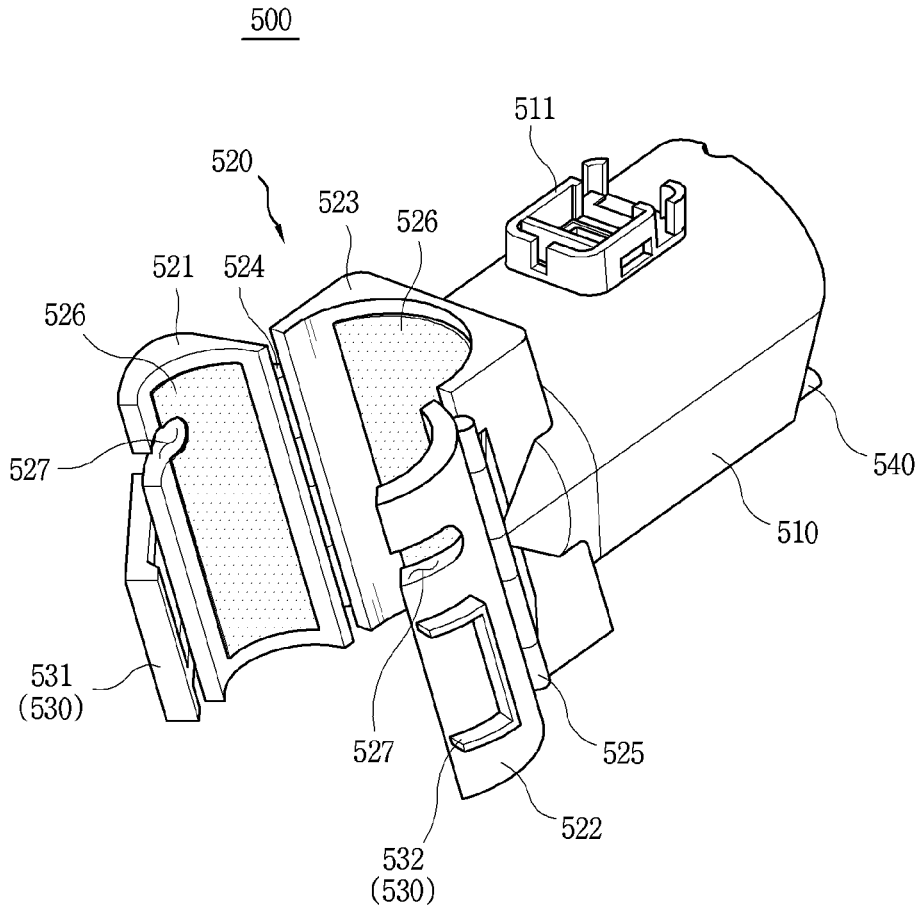
FIG. 5 is a perspective view illustrating an opened state of a conversion member included in the electric cleaner of FIG. 1.
Figure 6:
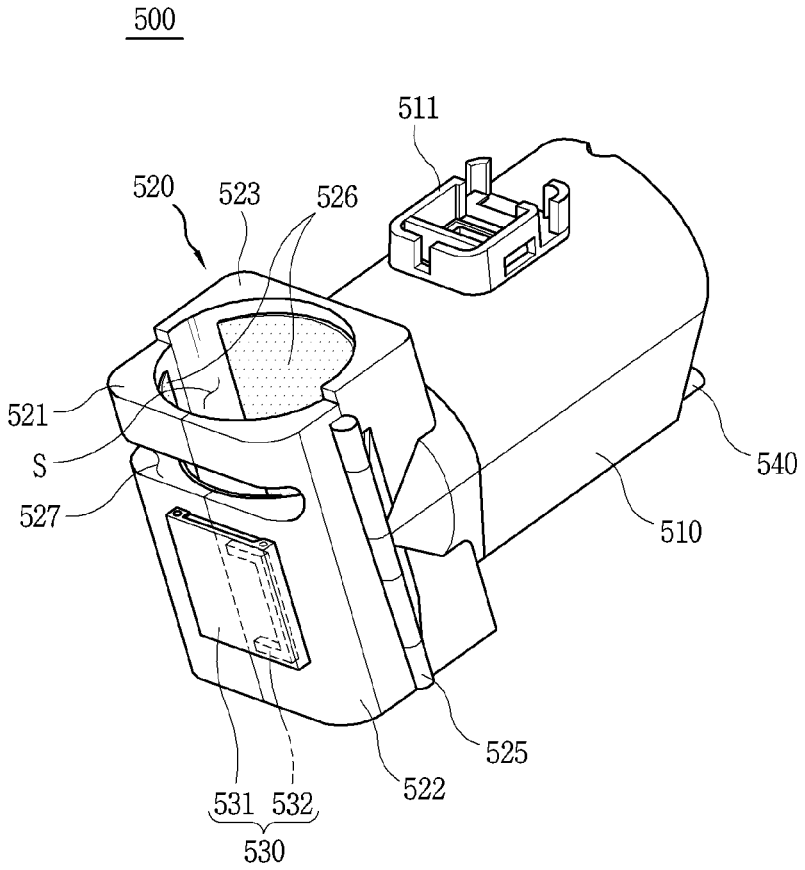
FIG. 6 is a perspective view illustrating a closed state of the conversion member included in the electric cleaner of FIG. 1.

In the embodiment illustrated in FIGS. 5 and 6, the first coupling portion 521 and the second coupling portion 522 are symmetrical to each other. That is, the first coupling portion 521 may cover half of the second extended portion 132, and the second coupling portion 522 may surround the other half of the second extended portion 132.

Figure 7:
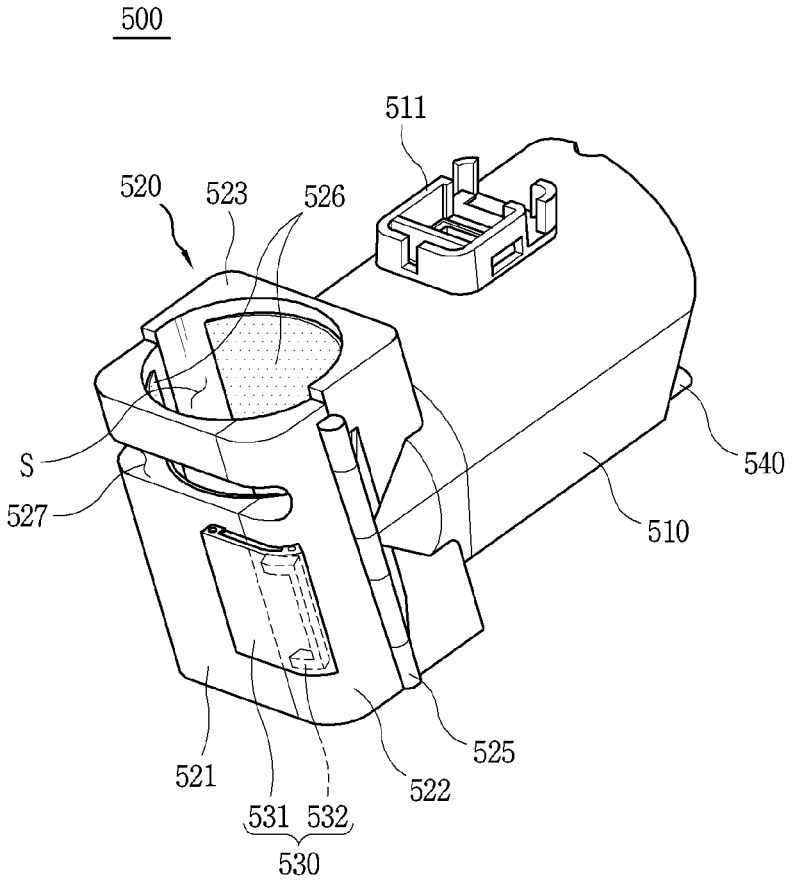
FIG. 7 is a perspective view of a conversion member according to another embodiment of the present disclosure.

In the embodiment illustrated in FIG. 7, the first coupling portion 521 has a larger width than the second coupling portion 522. That is, when the second extended portion 132 is accommodated in a coupling space S, an area of the second extended portion 132 covered by the first coupling portion 521 may be greater than an area of the second extended portion 132 covered by the second coupling portion 522.

That is, in this embodiment, the first coupling portion 521 may cover a right surface and a part (or some) of a bottom surface of the second extended portion 132. The second coupling portion 522 may cover another part (or other some) of the bottom surface and a left surface of the second extended portion 132.

Figure 8:
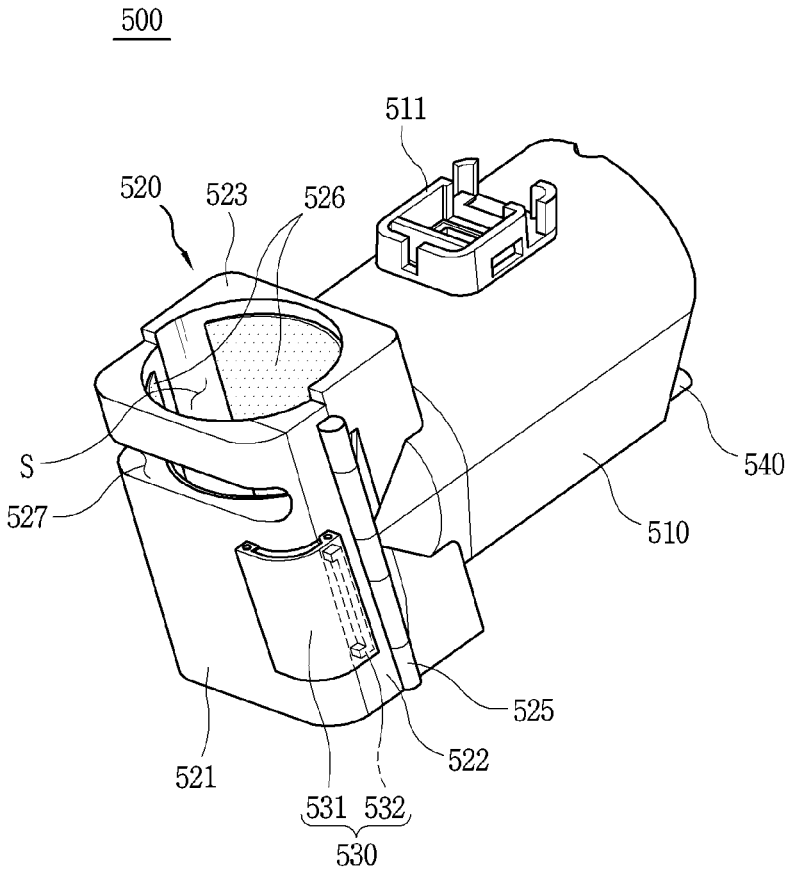
FIG. 8 is a perspective view of a conversion member according to yet another embodiment of the present disclosure.

In the embodiment illustrated in FIG. 8, the first coupling portion 521 has a larger width than the second coupling portion 522 as in the embodiment of FIG. 7, but its width is much greater than that of the first coupling portion 521 of the embodiment illustrated in FIG. 7. In this embodiment, the first coupling portion 521 may cover a right surface, a bottom surface and a part (or some) of a left surface of the second extended portion 132. The second coupling portion 522 may cover another part (or other some) of the left surface of the second extended portion 132.

According to the embodiments of FIGS. 7 and 8, the user may not need to put his or her hand into the space portion 134 of the handle 130 to manipulate the coupling unit 520 and the fastening portion 530. That is, the user may operate the coupling unit 520 and the fastening portion 530 from an outside of the space portion 134.

The connecting portion 523 may define the body of the coupling unit 520. The connecting portion 523 may be located at one side of the conversion connector 510, namely, the lower part of the conversion connector 510 in the illustrated embodiments. The connecting portion 523 may be connected to the conversion connector 510.

One side of the connecting portion 523, for example, a lower part of the connecting portion 523 in the illustrated embodiments may have a rounded shape in a direction toward the conversion connector 510, namely, an upward direction in the illustrated embodiments. A curvature of the one rounded side of the connecting portion 523 may be determined according to a curvature of the upper part of the second extended portion 132. The slip prevention portion 526 may be provided at one side facing the first coupling portion 521 or the second coupling portion 522, namely, the lower part of the connecting portion 523 in the illustrated embodiments.

As the connecting portion 523 is upwardly rounded, both ends of the connecting portion 523 may be located lower than a central portion thereof. The first hinge part 524 and the second hinge part 525 may be coupled to the both ends, respectively.

When the first coupling portion 521 and the second coupling portion 522 are coupled to each other, a space surrounded by the first coupling portion 521, the second coupling portion 522, and the connecting portion 523 is formed. The space may be defined as the coupling space S in which the second extended portion 132 is accommodated. That is, when the second extended portion 132 is accommodated in the coupling space S, the second extended portion 132 may be surrounded by the first coupling portion 521, the second coupling portion 522, and the connecting portion 523.

As described above, each of the first coupling portion 521, the second coupling portion 522, and the connecting portion 523 may have an outwardly rounded shape, and each of the curvatures may be determined according to the shape of the second extended portion 132. Accordingly, the second extended portion 132 accommodated in the coupling space S may not be moved or shaken. As a result, the main body 100 and the conversion member 500 may be securely coupled to each other.

The first hinge part 524 may connect the first coupling portion 521 to the connecting portion 523 in a rotatable manner. The first coupling portion 521 may be rotatably movable in a direction toward the second coupling portion 522 or in a direction away from the second coupling portion 522 while being connected to the connecting portion 523 by the first hinge part 524.

The first hinge part 524 may be connected to the connecting portion 523. In detail, of lower ends of the connecting portion 523, the first hinge part 524 may be connected to one end that faces the first coupling portion 521. The first hinge part 524 may be connected to the first coupling portion 521. In detail, the first hinge part 524 may be connected to one end of the first coupling portion 521 that faces the one end of the connecting portion 523.

The second hinge part 525 may connect the second coupling portion 522 to the connecting portion 523 in a rotatable manner. The second coupling portion 522 may be rotatably movable in a direction toward the first coupling portion 521 or in a direction away from the first coupling portion 521 while being connected to the connecting portion 523 by the second hinge part 525.

The second hinge part 525 may be connected to the connecting portion 523. In detail, of the lower ends of the connecting portion 523, the second hinge part 525 may be connected to another end that faces the second coupling portion 522.

The second hinge part 525 may be connected to the second coupling portion 522. In detail, the second hinge part 525 may be connected to one end of the second coupling portion 522 that faces the another end of the connecting portion 523.

The slip prevention portion 526 may be designed to prevent the second extended portion 132 from slipping on the coupling unit 520 after the second extended portion 132 and the coupling unit 520 are coupled to each other. The slip prevention portion 526 may be provided on at least one of inner surfaces of the first coupling portion 521, the second coupling portion 522, and the connecting portion 523.

In detail, the slip prevention portion 526 may be provided on surfaces that the first coupling portion 521 and the second coupling portion 522 face each other, and a surface of the connecting portion 523 toward the surfaces of the first coupling portion 521 and the second coupling portion 522. The slip prevention portion 526 may be provided on all the inner surfaces of the first coupling portion 521, the second coupling portion 522, and the connecting portion 523. This may allow the second extended portion 132 and the coupling unit 520 to be securely coupled to each other.

The slip prevention portion 526 may be made of a material capable of increasing a frictional force with a member in contact. In one embodiment, the slip prevention portion 526 may be made of a rubber or silicon material.

The slip prevention portion 526 may have a shape suitable for increasing a frictional force with a member in contact. In one embodiment, the slip prevention portion 526 may be provided in the form of unevenness including a plurality of convex and concave portions.

The penetrating portion 527 may be formed through the first coupling portion 521 and the second coupling portion 522, respectively. The penetrating portion 527 may be located at one side of the first coupling portion 521 and one side of the second coupling portion 522 directed to the detachment pressing portion 511.

The penetrating portion 527 may allow weight of the entire conversion member 500 to be reduced. In addition, as the penetrating portion 527 is provided, rigidity of the first coupling portion 521 and the second coupling portion 522 may be enhanced.

Further, the penetrating portion 527 may allow the user to determine whether the first coupling portion 521 and the second coupling portion 522 are correctly coupled to each other. In other words, the user may determine that the first coupling portion 521 and the second coupling portion 522 are properly coupled by checking whether the penetrating portion 527 extends along the second coupling portion 522 from the first coupling portion 521.

When the second extended portion 132 is accommodated in the coupling space S, the first coupling portion 521 and the second coupling portion 522 may be detachably coupled to each other by the fastening portion 530. That is, after the second extended portion 132 is covered by the first coupling portion 521 and the second coupling portion 522, this covered state may be maintained by the fastening portion 530.

The fastening portion 530 may be provided in a form that allows two or more different members to be detachably coupled to each other. In one embodiment, the fastening portion 530 may be coupled in a snap-fit manner. The fastening portion 530 may include the female fastening portion 531 and the male fastening portion 532.

The female fastening portion 531 may be rotatable so as to be detachably coupled with the male fastening portion 532. As the name suggests, the male fastening portion 532 is inserted into and detachably coupled to the female fastening portion 531.

The female fastening portion 531 may be rotatably coupled to the first coupling portion 521. A hinge member (not shown) may be provided so as to rotate the female fastening portion 531. The female fastening portion 531 may be spaced apart from the penetrating portion 527 by a predetermined distance, in a direction away from the detachment pressing portion 511.

A predetermined space may be formed inside the female fastening portion 531. The male fastening portion 532 may be detachably inserted into the space. A shape of the space may differ according to a shape of the male fastening portion 532.

The male fastening portion 532 may be located at the second coupling portion 522. The male fastening portion 532 may be spaced apart from the penetrating portion 527 by a predetermined distance, in a direction away from the detachment pressing portion 511.

The male fastening portion 532 may be inserted into and detachably coupled to the female fastening portion 531. After the first coupling portion 521 and the second coupling portion 522 are coupled to each other, the female fastening portion 531 may be rotated in a direction toward the male fastening portion 532 so as to receive and hold the male coupling portion 532.

When the male fastening portion 532 is insertedly coupled to the female fastening portion 531, the male fastening portion 532 may not be separated from the female fastening portion 531 unless an external force is applied by the user. Accordingly, the main body 100 and the conversion member 500 may be securely coupled to each other.

The conversion electric connection unit (or electric connector) 540 may provide electric connection between the conversion member 500 and the main body 100, or between the conversion member 500 and the pipe 200. The conversion electric connection unit 540 may be provided in a form that allows the electric connection. In one embodiment, the conversion electric connection unit 540 may be configured as a copper wire.

The conversion electric connection unit 540 may extend inside the conversion member 500 (see FIGS. 9 and 10). In detail, the conversion electric connection unit 540 may extend upward from the lower part of the conversion member 500. In addition, the conversion electric connection unit 540 may be accommodated in the wall portion 513 of the conversion member 500. The conversion electric connection unit 540 disposed inside the wall portion 513 may extend along the wall portion 513.

A lower part of the conversion electric connection unit 540 may be located at the lower part of the connecting portion 523, namely, one side facing the main body 100. When the second extended portion 132 is accommodated in the coupling space S, the lower part of the conversion electric connection unit 540 and the main body electric connection unit 150 may be electrically connected to each other.

In one embodiment, an end of the lower part of the conversion electric connection unit 540 may be implemented as a pogo pin. In this embodiment, the conversion electric connection unit 540 and the main body electric connection unit 150 may be in contact with each other so as to be electrically connected to each other.

An upper part of the conversion electric connection unit 540 may be located at an upper part of the conversion connector 510, namely, one side facing the pipe 200. When the male connector 230 is insertedly coupled to the through hole 512 of the conversion connector 510, the upper part of the conversion electric connection unit 540 may be electrically connected to the pipe electric connection unit 240 of the pipe 200.

Accordingly, the main body 100, the pipe 200, and the conversion member 500 may be electrically connected to one another. In addition, the pipe 200 and the extension handle 400 may be electrically connected to each other, and the intake port 300 and the main body 100 may be electrically connected to each other.

As a result, power and a control signal applied to the extension switch 420 of the extension handle 400 may be transmitted to the main body 100 and the intake port 300. Therefore, even when the main body 100 is directly connected to the intake port 300 at the lower position, the user may control the electric cleaner 10 at the same height as when the main body 100 is connected to the upper part of the pipe 200. This may result in improving user convenience.

The electric cleaner 10 according to the embodiment of the present disclosure may include the joint unit 600. The joint unit 600 may connect the housing 310 and the intake connector 330 of the intake port 300 in a rotatable manner. The joint unit 600 may cause the housing 310 to be rotated relative to the intake connector 330 according to how the user uses the electric cleaner 10.

In addition, the housing 310 and the intake connector 330 may be securely coupled to each other by the joint unit 600. The joint unit 600 may allow the electric cleaner 10 to be upright, namely, self-standing without any separate or additional member.

Figure 11:
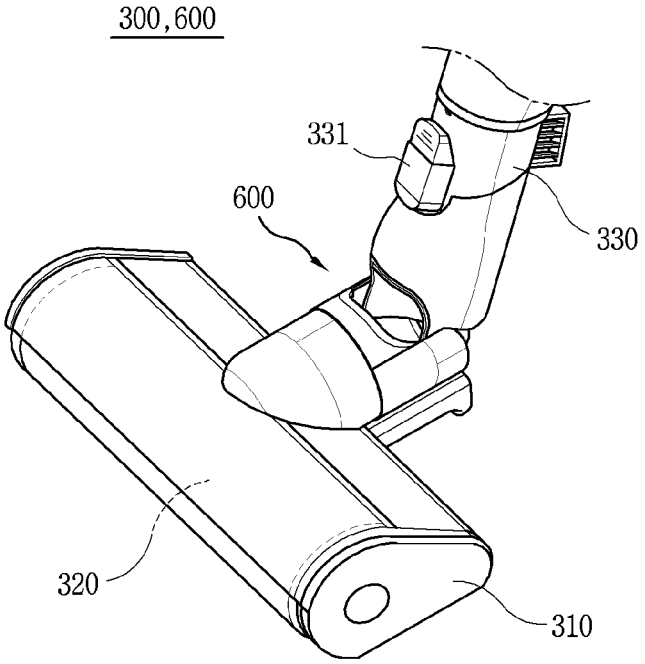
FIG. 11 is a perspective view illustrating a joint unit included in the electric cleaner of FIG. 1.

Hereinafter, the joint unit 600 according to an embodiment of the present disclosure will be described in detail with reference to FIGS. 11 to 13. In the illustrated embodiment, a lower part of the joint unit 600 is connected to the housing 310. In addition, an upper part of the joint unit 600 is connected to the intake connector 330. The lower part and the upper part of the joint unit 600 may be rotated relative to each other.

In the illustrated embodiment, the joint unit 600 includes an insertion portion (or insertion wall) 610 and an accommodating (or receiving) portion (or accommodating wall) 620. The insertion portion 610 may be located at the upper part of the joint unit 600 that is connected to the housing 310. The insertion portion 610 may be inserted into and detachably coupled to the accommodating portion 620 provided at the lower part of the joint unit 600.

The insertion portion 610 may be located at one side of the intake connector 330, for example, a front part of the intake connector 330 in the illustrated embodiment. In addition, the insertion portion 610 may be located adjacent to the housing 310.

In the illustrated embodiment, the insertion portion 610 may include an insertion body 611 and an insertion protrusion 612. The insertion body 611 may define the body of the insertion portion 610. The insertion body 611 may protrude from an outer circumferential surface of the one side of the intake connector 330. In the illustrated embodiment, the insertion body 611 is located on a front circumferential surface of the intake connector 330.

One corner of the insertion body 611 facing the accommodating portion 620, namely, an upper front corner of the insertion body 611 may have a rounded shape in the illustrated embodiment. The insertion protrusion 612 may protrude from a lower portion of the upper corner by a predetermined length.

The insertion protrusion 612 may be accommodated in the accommodating portion 620. In detail, the insertion protrusion 612 may be fittingly coupled to a space portion (or recess) 622. Once the insertion protrusion 612 is fittingly coupled to the space portion 622, the insertion portion 610 and the accommodating portion 620 may not be separated from each other. A specific external force is required to separate the insertion portion 610 and the accommodating portion 620 from each other.

The protruding length of the insertion protrusion 612 may be shorter than a protruding length of an outer circumferential portion 621 of the accommodating portion 620. In addition, the protruding length of the insertion protrusion 612 may be shorter than a length of the space portion 622 of the accommodating portion 620.

One side of the insertion protrusion 612 facing the accommodating portion 620, namely, a front end of the insertion protrusion 612 may have a flat shape in the illustrated embodiment. The insertion portion 610 may be inserted into and detachably coupled to the accommodating portion 620. Once the insertion portion 610 is inserted into the accommodating portion 620, they may not be separated from each other.

The accommodating portion 620 may be located at the housing 310. In detail, the accommodating portion 620 may be located at one side of the housing 310, namely, an upper part of the housing 310 in the illustrated embodiment. Also, the accommodating portion 620 may be located adjacent to the intake connector 330.

In the illustrated embodiment, the accommodating portion 620 may include the outer circumferential portion 621, the space portion 622 and a bottom portion 623. The outer circumferential portion 621 may protrude upward from the one side of the housing 310 by a predetermined distance. A predetermined space may be formed between the outer circumferential portion 621 and a surface of the one side of the housing 310. The space may be defined as the space portion 622.

In addition, the outer circumferential portion 621 may protrude in a direction toward the intake connector 330 by a predetermined distance. One end of the outer circumferential portion 621 facing the intake connector 330 may be in contact with one side of the insertion body 611 facing the accommodating portion 620, namely, a front end of the insertion body 611 in the illustrated embodiment.

The outer circumferential portion 621 may protrude to an extent enough to apply a specific external force when the insertion protrusion 612 is coupled while rotating in a counterclockwise direction. That is, the outer circumferential portion 621 may extend such that one end facing the insertion portion 610 is located within a rotation radius of one end of the insertion protrusion 612 facing the accommodating portion 620.

A lower portion of the one end of the outer circumferential portion 621 may be inclined or tilted. When the insertion protrusion 612 is inserted into the space portion 622, a surface of the front end of the insertion protrusion 612 may be brought into contact with a lower surface of the one end of the outer circumferential portion 621. In one embodiment, the contact may be a surface contact.

The space portion 622 may be provided at one side of the outer circumferential portion 621 facing the housing 310. The space portion 622 may be a space formed inside the outer circumferential portion 621. In addition, the bottom portion 623 may be formed at a lower part of the space portion 622. That is, the space portion 622 is a space surrounded by an inner surface of the outer circumferential portion 621 and the bottom portion 623.

One side of the space portion 622 facing the insertion portion 610, namely, a rear side of the space portion 622 is opened in the illustrated embodiment. The insertion protrusion 612 may be accommodated in the space portion 622 through the opened side.

The space portion 622 may extend in a direction toward the intake connector 330 or away from the intake connector 330, for example, in a front-rear direction by a predetermined length in the illustrated embodiment. The predetermined length may be longer than the protruding length of the insertion protrusion 612.

The bottom portion 623 may be formed at the lower side of the space portion 622. The bottom portion 623 may define the bottom of the accommodating portion 620. The bottom portion 623 may surround the space portion 622 from the bottom.

The bottom portion 623 may be spaced apart from the outer circumferential portion 621 by a predetermined distance. Accordingly, the space portion 622 may be formed between the bottom portion 623 and the outer circumferential portion 621. When the insertion protrusion 612 is inserted into the space portion 622, the insertion protrusion 612 may be seated on the bottom portion 623.

The bottom portion 623 may protrude by a predetermined distance from one side of the housing 310, namely, an upper surface of the housing 310 in the illustrated embodiment. The bottom portion 623 may protrude to an extent enough for the insertion protrusion 612 inserted into the space portion 622 to be securely seated.

In one embodiment, while the insertion portion 610 is insertedly coupled to the accommodating portion 620, an angle between the upper surface of the housing 310 and the outer circumferential surface of the intake connector 330 may be a right angle (90°).

Figure 12:
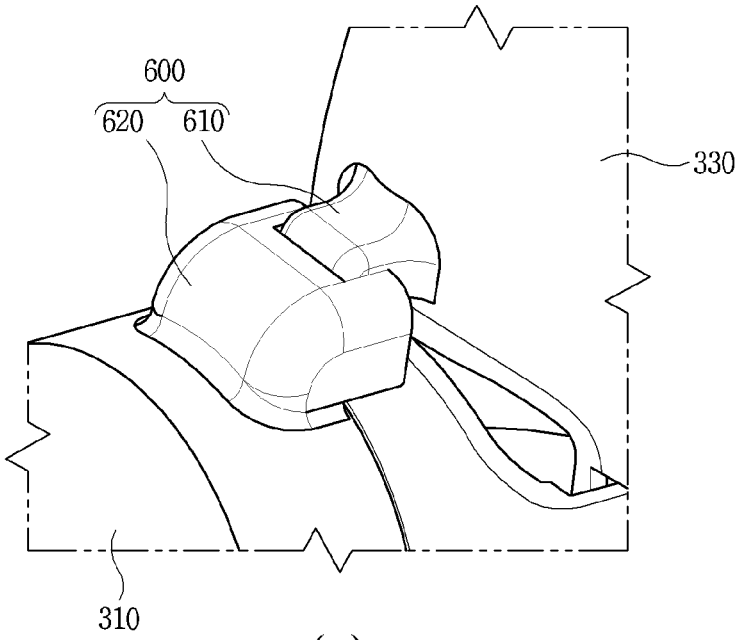
FIG. 12 is a partially enlarged perspective and cross-sectional view illustrating a self-standing state of the electric cleaner of FIG. 1.
Figure 12:
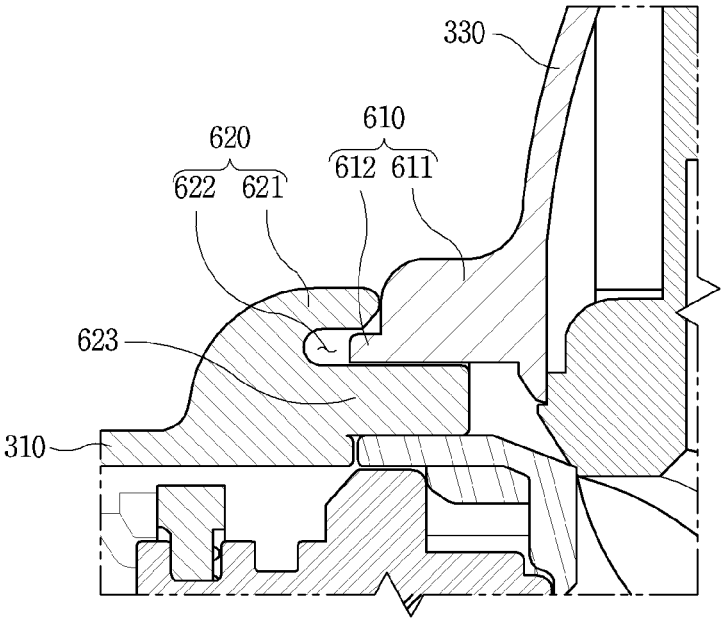

Referring to section (b) of FIG. 12, it will be understood that the insertion protrusion 612 is inserted into the space portion 622 by rotating counterclockwise. Similarly, it will also be understood that the insertion protrusion 612 is detached from the space portion 622 by rotating clockwise.

In one embodiment, the insertion portion 610 may be fittingly coupled to the accommodating portion 620. That is, the insertion protrusion 612 may be fittingly coupled to the space portion 622 by an external force applied from the outer circumferential portion 621. Accordingly, once the insertion protrusion 612 is coupled to the space portion 622, the insertion portion 610 and the accommodating portion 620 may not be separated from each other unless an external force is applied.

Figure 13:
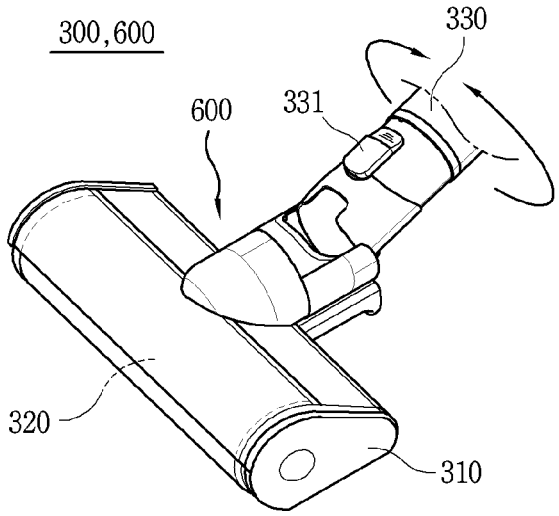
FIG. 13 is a conceptual view illustrating a self-standing process of the electric cleaner of FIG. 1.
Figure 13:
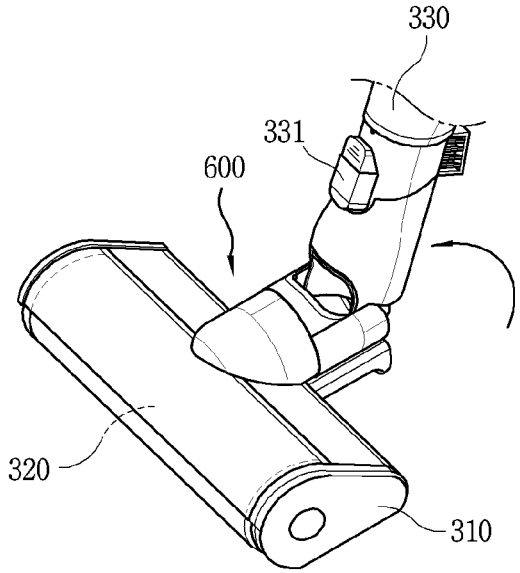

Referring to FIG. 13, a process in which the housing 310 and the intake connector 330 are rotated relative to each other by the joint unit 600 is illustrated. First, referring to section (a) of FIG. 13, the insertion portion 610 and the accommodating portion 620 are separated from each other. In this state, the intake connector 330 may be rotated relative to the housing 310. That is, the intake connector 330 may be rotated clockwise or counterclockwise with respect to the joint unit 600.

Referring to section (b) of FIG. 13, the insertion portion 610 is inserted into and detachably coupled to the accommodating portion 620. In this state, the intake connector 330 may be rotatably movable relative to the housing 310. That is, the intake connector 330 may move in a direction toward the housing 310 or in a direction away from the housing 310. Here, the intake connector 330 may be rotated centered on a portion where the upper part and the lower part of the joint unit 600 are connected.

When the intake connector 330 is sufficiently moved toward the housing 310, the insertion protrusion 612 may be brought into contact with the outer circumferential portion 621 to be inserted into the space portion 622. That is, in the joint unit 600 according to the embodiment of the present disclosure, the upper part of the joint unit 600 may be rotated clockwise or counterclockwise (hereinafter, referred to as "first rotation"). In addition, the upper part of the joint unit 600 may be rotated in a direction toward the intake port 300 or in a direction away from the intake port 300 (hereinafter, referred to as "second rotation").

Here, when the joint unit 600 is in a non-coupled state, both the first rotation and the second rotation may be available. The user may adjust left and right directions of the insertion portion 610 and the accommodating portion 620 through the first rotation.

As the insertion portion 610 is rotated in the front-rear direction, a direction of the joint unit 600 may be adjusted to allow the insertion portion 610 to be coupled to the accommodating portion 620. Then, the user may rotate the insertion portion 610 toward the accommodating portion 620 through the second rotation. It will be understood that the first rotation is not allowed while the insertion portion 610 is insertedly coupled to the accommodating portion 620.

On the other hand, while the joint unit 600 is in a coupled state, the user may rotate the insertion portion 610 to be away from the accommodating portion 620 through the second rotation. Thereafter, the first rotation or the second rotation of the joint unit 600 may be available.

While the joint unit 600 is in a coupled state, the first rotation may not be allowed. Accordingly, the insertion portion 610 and the accommodating portion 620 may be securely coupled to each other. Therefore, self-standing of the electric cleaner 10 may be achieved by coupling the insertion portion 610 and the accommodating portion 620 to each other.

The electric cleaner 10 according to the embodiment of the present disclosure may easily change a relative position between the main body 100 and the intake port 300 by using the conversion member 500. That is, a state in which the main body 100 and the intake port 300 are indirectly connected through the pipe 200 (hereinafter, "up-center state" (high center of gravity)), and a state in which the main body 100 and the intake port 300 are directly connected (hereinafter, "down-center state" (low center of gravity)) may be easily changed to each other.

Hereinafter, a process of how a center of gravity (or mass) of the electric cleaner 10 according to the embodiment of the present disclosure will be described in detail with reference to FIGS. 14 to 19. In FIGS. 14 to 19, the electric cleaner 10 is changed from the up-center state to the down-center state.

In FIG. 14, the electric cleaner 10 having a high center of gravity is illustrated. The intake port 300 may be located at the lowermost part (or lowest position) of the electric cleaner 10. A lower part of the pipe 200 may be connected to the intake port 300 and an upper part thereof may be connected to the main body 100. That is, the main body 100 may be located at the uppermost part (or highest position) of the electric cleaner 10.

Figure 15:
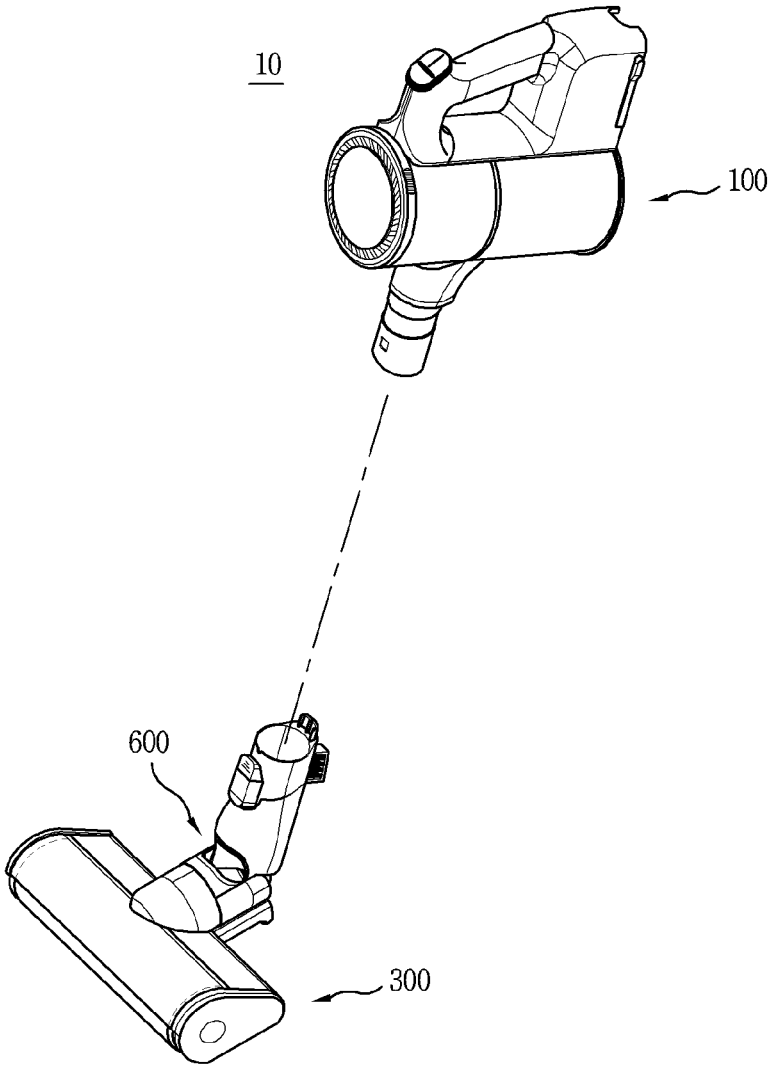

Referring to FIG. 15, the pipe 200 is separated from the main body 100 and the intake port 300. As described above, the pipe 200 may be separated by pressing the detachment pressing portion 331 of the intake port 300 and the detachment pressing portion 221 of the pipe 200.

Figure 16:
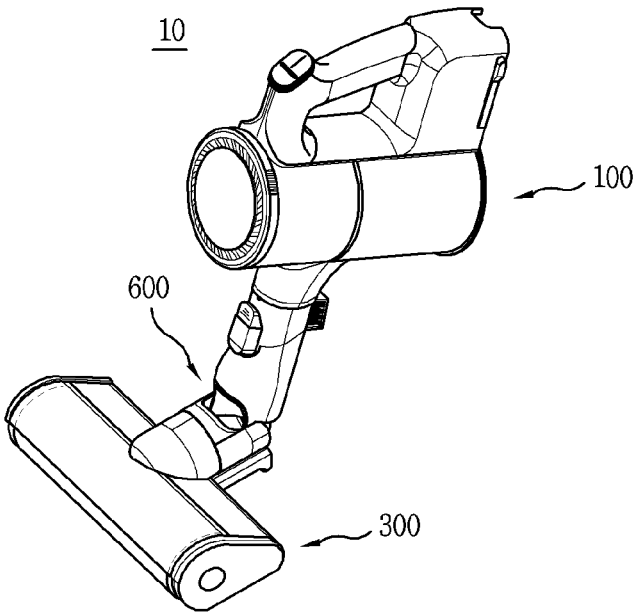

In FIG. 16, the main body 100 is directly coupled to the intake port 300. This may be allowed when the main body connector 120 of the main body 100 is inserted into and detachably coupled to the intake connector 330 of the intake port 300. Accordingly, the main body electric connection unit 150 and the intake electric connection unit 340 may be electrically connected to each other. This may allow power and a control signal applied to the main body 100 to be transmitted to the intake port 300.

Figure 17:
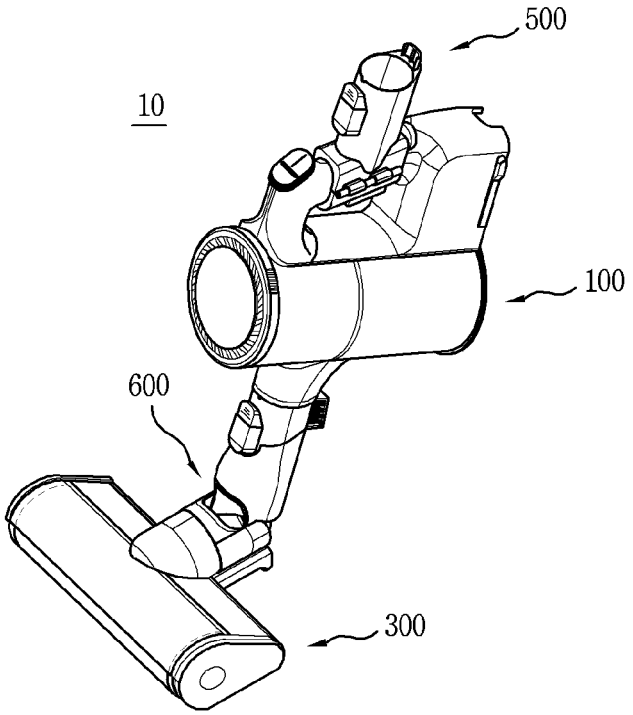

Referring to FIG. 17, the conversion member 500 is coupled to the main body 100. The process will be described in detail as follows. First, the first coupling portion 521 and the second coupling portion 522 of the conversion member 500 may be rotated to be away from each other. As described above, the first coupling portion 521 and the second coupling portion 522 may be rotated centered on the first hinge part 524 and the second hinge part 525, respectively.

Next, one surface of the connecting portion 523 facing the main body 100, namely, a lower surface of the connecting portion 523 may be brought into contact with one surface of the second extended portion 132 facing the conversion member 500, for example, an upper surface of the second extended portion 132 in the illustrated embodiment.

Then, the first coupling portion 521 and the second coupling portion 522 are rotated toward each other. Accordingly, ends of the first coupling portion 521 and the second coupling portion 522 that face each other may be in contact with each other. In addition, the first coupling portion 521 and the second coupling portion 522 may be located at the space portion 134. This may allow the second extended portion 132 to be accommodated in the coupling space S which is surrounded by the first coupling portion 521, the second coupling portion 522, and the connecting portion 523.

Next, the female fastening portion 531 may be rotated to be detachably coupled with the male fastening portion 532. Then, the conversion member 500 and the main body 100 may be coupled to each other. Meanwhile, the slip prevention portion 526 may be provided on respective inner surfaces that the first coupling portion 521, the second coupling portion 522, and the connecting portion 523 face each other. The slip prevention portion 526 may be in contact with each of surfaces of the second extended portion, so as to increase a frictional force generated therebetween.

Accordingly, while the conversion member 500 is coupled to the second extended portion 132, the conversion member 500 may not be slipped or rotated. Thus, the conversion member 500 and the main body 100 may be securely coupled to each other.

Further, this may allow the main body electric connection unit 150 and the conversion electric connection unit 540 to be electrically connected to each other. As described above, the main body electric connection unit 150 and the conversion electric connection unit 540 may be implemented as a pogo pin, so as to be electrically connected to each other in a contact manner.

Figure 18:
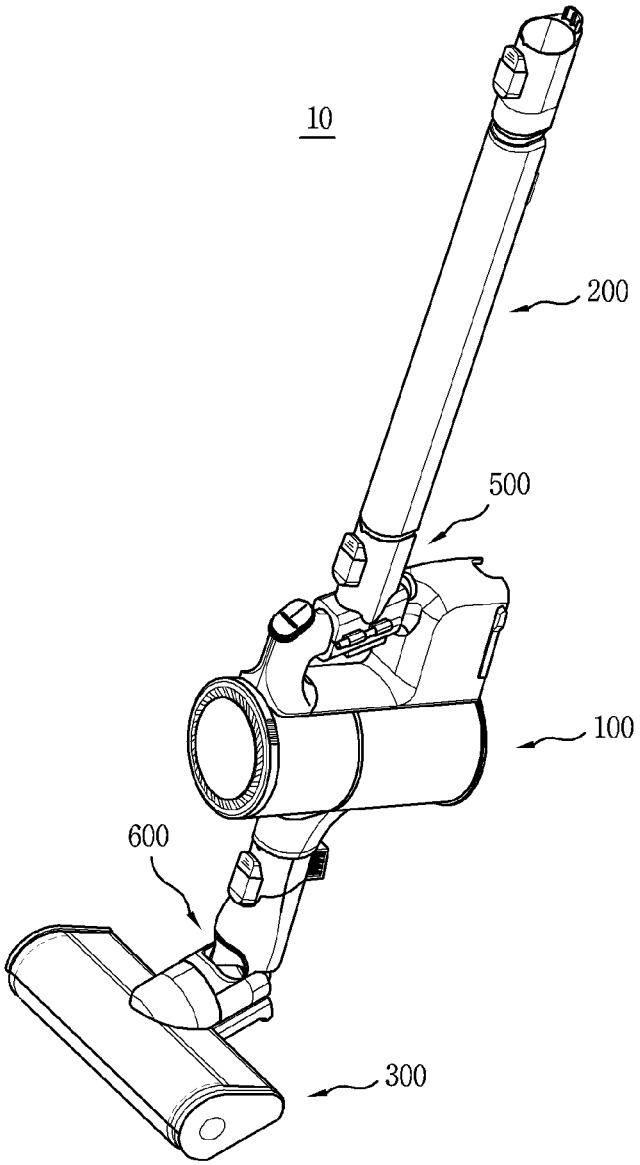

Referring to FIG. 18, the pipe 200 is coupled to the conversion member 500. This may be achieved when the male connector 230 of the pipe 200 is inserted into and detachably coupled to the conversion connector 510 of the conversion member 500. Meanwhile, the conversion electric connection unit 540 and the pipe electric connection unit 240 may be electrically connected to each other by this coupling.

Figure 19:
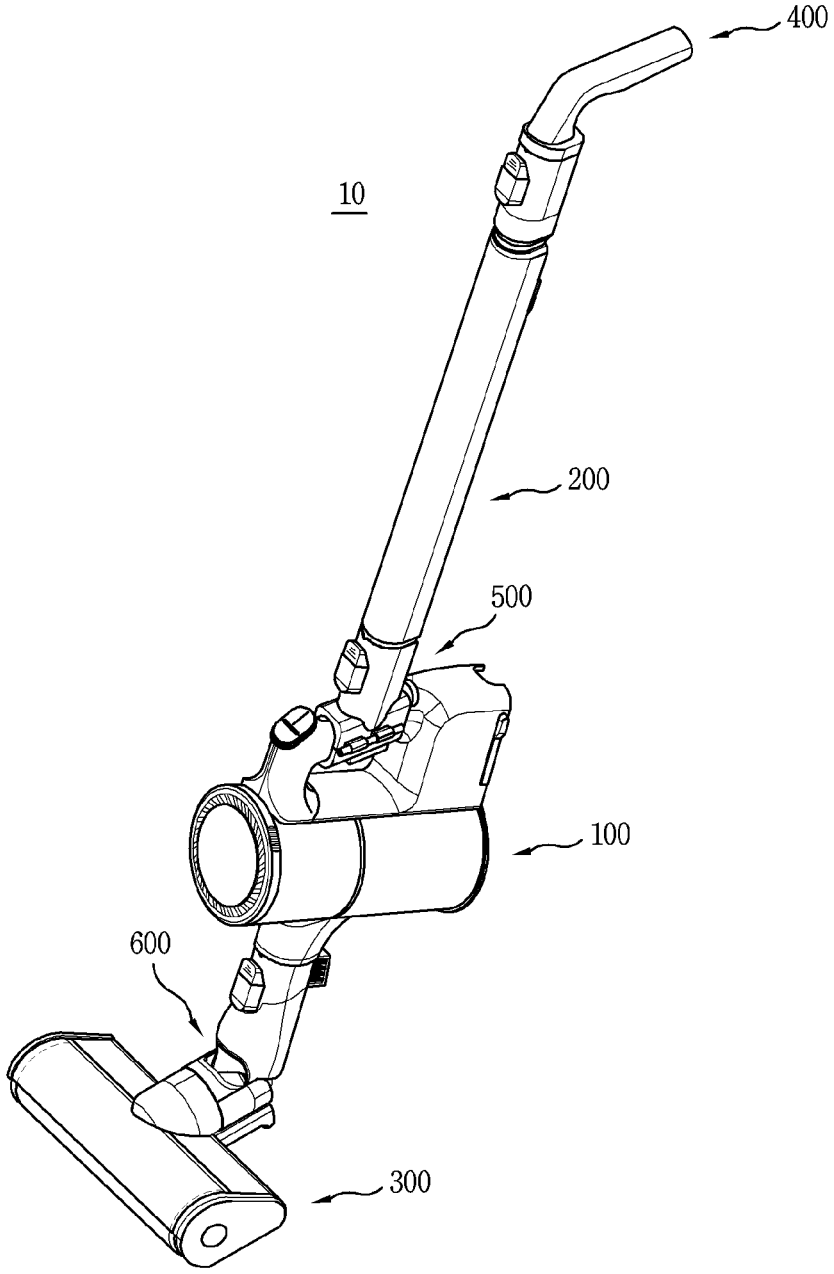

Referring to FIG. 19, the extension handle 400 is coupled to the pipe 200. This may be achieved when the extension connector 430 of the extension handle 400 is insertedly coupled to the female connector 220 of the pipe 200. Meanwhile, the extension electric connection unit 450 and the pipe electric connection unit 240 may be electrically connected to the each other by this coupling.

Accordingly, the intake port 300, the main body 100, the conversion member 500, the pipe 200, and the extension handle 400 may be electrically connected to one another. As a result, power and a control signal input by the user through the extension switch 420 of the extension handle 400 may be transmitted to the main body 100 and the intake port 300.

As described with reference to FIGS. 14 to 19, the electric cleaner 10 according to the embodiment of the present disclosure may be easily converted from the up-center state to the down-center state by using the conversion member 500. When the electric cleaner 10 is in the down-center state as illustrated in FIG. 19, the above-described process may be performed in the reverse order so that the electric cleaner 10 is changed to have the up-center state. Therefore, the center of gravity of the electric cleaner 10 may be easily changed using the conversion member 500 without replacing the existing electric cleaner 10 itself.

A description of electric cleaner 10 according to an embodiment when placed on stand holder 20. The electric cleaner 10 according to the embodiment of the present disclosure may be recharged by using the stand holder 20. In addition, vertical length adjustments of the electric cleaner 10 and the stand holder 20 may be available. Accordingly, when the electric cleaner 10 is in any one of the up-center state and the down-center state, adjustments in length of the stand holder 20 may also be available, as described above.

Hereinafter, a state in which the electric cleaner 10 according to the embodiment of the present disclosure is coupled to the stand holder 20 will be described in detail with reference to FIGS. 20 to 21. In the illustrated embodiment, the stand holder 20 includes a base 21, a support (or support rail) 22, and a charging unit (or charger) 23.

The base 21 may be located at the lowermost part of the stand holder 20. The base 21 may support the stand holder 20, so that the stand holder 20 is in a standing state. In addition, the intake port 300 of the electric cleaner 10 may be located above the base 21. In one embodiment, the intake port 300 may be seated on an upper part of the base 21.

The support 22 may extend from the base 21 by a predetermined length. A lower part of the support 22 may be detachably coupled to the base 21. The support 22 may support the charging unit 23. Adjustments in length of the support 22 may be available. That is, the length of the support 22 may be extended when the electric cleaner 10 is in the up-center state, and may be reduced when the electric cleaner 10 is in the down-center state. The support 22 may be provided in a shape that allows length adjustments. In one embodiment, the support 22 may be implemented as a rail.

The charging unit 23 may be configured to recharge the battery (not shown) provided in the main body 100 of the electric cleaner 10. In addition, the charging unit 23 may support the main body 100, which is the heaviest component of the electric cleaner 10.

The charging unit 23 and the main body 100 may be electrically connected to each other. In one embodiment, the charging unit 23 may be provided with a pogo pin terminal (not shown). When the main body 100 is seated on the charging unit 23, a pogo pin (not shown) electrically connected to the battery (not shown) of the main body 100 may come in contact with a pogo pin of the charging unit 23 so as to be electrically connected to each other. The charging unit 23 may be connected to the support 22. A height of the charging unit 23 may be changed as the length of the support 22 is adjusted.

In FIG. 20, the main body 100 and the intake port 300 are indirectly connected through the pipe 200. That is, the electric cleaner 10 is in the up-center state. The main body 100 may be seated or placed on the charging unit 23. This may allow the battery (not shown) of the main body 100 to be recharged. In addition, the intake port 300 may be seated on an upper surface of the base 21. In FIG. 20, the support 22 is in an extended state. In other words, a height of the support 22 may be extended to a position where the main body 100 located at an upper part of the electric cleaner 10 is placed on the charging unit 23.

In FIG. 21, the main body 100 and the intake port 300 are directly connected to each other. That is, the electric cleaner 10 is in the down-center state. The main body 100 may be seated or placed on the charging unit 23. Accordingly, the battery (not shown) of the main body 100 may be recharged. In addition, the intake port 300 may be spaced apart from the upper surface of the base 21 by a predetermined distance.

In FIG. 21, the support 22 is in a reduced state. That is, the height of the support 22 may be reduced to a position where the main body 100 located at a lower part of electric cleaner 10 is placed on the charging unit 23. That is, in the stand holder 20 according to the present disclosure, the length of the support 22 may be easily adjusted. Accordingly, an additional stand holder may not be required for placing and recharging the electric cleaner 10 in the up-center state or the down-center state.

The foregoing description has been given of the preferred embodiments, but it will be apparent to those skilled in the art that various modifications and variations can be made in the present disclosure without departing from the concept or scope of the disclosure as defined in the appended claims.

Embodiments described herein provide a conversion member capable of solving the aforementioned problems, and an electric cleaner including the same. One aspect of the present disclosure is to provide a conversion member capable of easily changing a position of a main body to be located relatively high or low, and an electric cleaner including the same.

Another aspect of the present disclosure is to provide a conversion member having a structure that can easily change a position of a main body to be located relatively high or low without having to purchase an additional cleaning device, and an electric cleaner including the same. Still another aspect of the present disclosure is to provide a conversion member that can be easily coupled and detached to and from a main body, and an electric cleaner including the same.

Still another aspect of the present disclosure is to provide a conversion member that can be securely coupled to a main body, and an electric cleaner including the same. Still another aspect of the present disclosure is to provide a conversion member having a structure that can be easily gripped by a user even when a main body is located at a lower position, and an electric cleaner including the same.

Still another aspect of the present disclosure is to provide a conversion member having a structure in which a user can feel the same or similar sense of grip regardless of a position of a main body, whether at an upper position or a lower position, and an electric cleaner including the same. Still another aspect of the present disclosure is to provide a conversion member having a structure in which a user can easily apply power and a control signal even when a main body is located at a lower position, and an electric cleaner including the same.

Still another aspect of the present disclosure is to provide a conversion member capable of self-standing without a separate stand holder, and an electric cleaner including the same. Still another aspect of the present disclosure is to provide a conversion member that can be placed on a stand holder regardless of a relative position of a main body, and an electric cleaner including the same.

Embodiments disclosed herein provide a conversion member that may include a conversion connector in which a pipe extending in one direction is detachably inserted, a coupling unit connected to the conversion connector in a direction opposite to the pipe and detachably coupled to a main body having a dust container. The coupling unit may include a connecting portion connected to the conversion connector, a first coupling portion rotatably coupled to the connecting portion, and a second coupling portion disposed to face the first coupling portion and rotatably coupled to the connecting portion.

In addition, one surface of the connecting portion facing the main body may be designed to be rounded in a direction toward the conversion connector, and surfaces of the first coupling portion and the second coupling portion that face each other may be designed to be rounded in a direction away from each other.

The coupling unit may include a first hinge part coupled respectively to one side of the connecting portion and one side of the first coupling portion facing the connecting portion, and a second hinge part coupled respectively to one side of the connecting portion and one side of the second coupling portion facing the connecting portion.

The coupling unit may include a slip prevention portion provided on at least one of surfaces that the first coupling portion and the second coupling portion face each other, so as to increase a frictional force between the main body and the at least one of the surfaces that the first coupling portion and the second coupling portion face each other. The coupling unit may include a slip prevention portion provided on one surface of the connecting portion facing the main body, so as to increase a frictional force between the main body and the one surface of the connecting portion.

In addition, the conversion member may include a female fastening portion rotatably coupled to any one of the first coupling portion and the second coupling portion, a male fastening portion provided at another one of the first coupling portion and the second coupling portion. The female fastening portion and the male fastening portion may be detachably coupled to each other.

Embodiments disclosed herein also provide an electric cleaner that may include a main body having a dust container, an intake port detachably coupled to one side of the main body, communicating with the dust container and electrically connected to the main body, a conversion member detachably coupled to another side of the main body and electrically connected to the main body, and a pipe detachably coupled to the conversion member and electrically connected to the conversion member. The main body may include a handle extending toward the conversion member. The conversion member may include a conversion connector in which the pipe is detachably inserted, a coupling unit connected to the conversion connector in a direction opposite to the pipe and detachably coupled to the handle. The coupling unit may include a connecting portion connected to the conversion connector, a first coupling portion rotatably coupled to the connecting portion, and a second coupling portion disposed to face the first coupling portion and rotatably coupled to the connecting portion.

In addition, the coupling unit may be formed such that one surface of the connecting portion facing the handle, and surfaces of the first coupling portion and the second coupling portion that face each other are rounded in a direction away from the handle. The coupling unit may include a first hinge part coupled respectively to one side of the first coupling portion facing the connecting portion and one side of the connecting portion facing the first coupling portion, and a second hinge part coupled respectively to one side of the second coupling portion facing the connecting portion and one side of the connecting portion facing the second coupling portion.

The coupling unit may include a slip prevention portion provided on one surface of the connecting portion facing the handle, and surfaces of the first coupling portion and the second coupling portion that face each other, so as to increase a frictional force between the handle and the coupling unit.

The conversion member of the electric cleaner may include a female fastening portion rotatably coupled to one surface of the first coupling portion facing the main body, and a male fastening portion provided at one surface of the second coupling portion facing the main body. The female fastening portion and the male fastening portion may be detachably coupled to each other.

In addition, the electric cleaner may include an extension handle detachably coupled to the pipe and electrically connected with the pipe. The extension handle may include a grip portion located opposite to the pipe. The grip portion may include a first portion extending in a direction away from the pipe by a predetermined length, and a second portion continuous with the first portion and extending at a predetermined angle with respect to the first portion.

The handle of the main body of the electric cleaner may include a first extended portion extending toward the conversion member by a predetermined length, a second extended portion continuous with the first extended portion and extending at a predetermined angle with respect to the first extended portion, and a third extension portion continuous with the second extended portion and extending at a predetermined angle with respect to the second extended portion in a direction away from the conversion member by a predetermined length.

The predetermined angle between the first portion and the second portion of the extension handle may be within a range of 90% to 110% of the predetermined angle between the first extended portion and the second extended portion of the handle. Further, the predetermined angle between the first portion and the second portion of the extension handle may be equal to the predetermined angle between the first extended portion and the second extended portion of the handle. The extension handle may be located at the first portion and include an extension switch configured to receive power and a control signal.

According to embodiments disclosed herein, the following aspect can be achieved. First, a conversion member is provided to change a position of a main body to be relatively low. The main body and the conversion member may be detachably coupled to each other. The main body and an intake port are detachably coupled to each other, and the conversion member and a pipe are detachably coupled to each other. That is, even if a position of the main body is located relatively low, adjacent to the intake port, a sufficient length to be gripped by a user can be achieved by the pipe.

Further, when the position of the main body is converted to be relatively high, the intake port is detachably coupled with the pipe. As the main body and the pipe are detachably coupled to each other, the main body may be located at the highest position of an electric cleaner.

Accordingly, the position of the main body can be easily changed to a lower or higher position. In addition, converting the position of the main body described above can be achieved by an electric cleaner and a conversion member that a user already has. Accordingly, even if the user owns the electric cleaner having a main body located at an upper position, the user can also use an electric cleaner having a main body located at a lower position by simply purchasing an additional conversion member. Thus, the user can change a relative position of the main body according to the purpose of use without having to buy a plurality of different electric cleaners having different main body positions, thereby improving user convenience and saving costs.

In addition, the conversion member includes a coupling unit having a connecting portion, and a first coupling portion and a second coupling portion rotatably coupled to the connecting portion. The coupling unit is brought into contact with a handle of the main body while the first coupling portion and the second coupling portion are spaced apart from each other.

In this state, the first coupling portion and the second coupling portion are inserted into a space portion formed in the handle of the main body. When the first coupling portion and the second coupling portion are bought into contact with each other, the handle of the main body is accommodated in a coupling space portion. Accordingly, the user may rotate the first coupling portion and the second coupling portion to couple or separate the conversion member to and from the main body. This may result in improving user convenience.

In addition, the conversion member is provided with a fastening portion. The fastening portion includes a female fastening portion provided at the first coupling portion and a male fastening portion provided at the second coupling portion. When the first coupling portion and the second coupling portion are brought into contact with each other, the female coupling portion and the male coupling portion are detachably coupled to each other. The female fastening portion and the male fastening portion are not separated from each other unless an external force is applied. Accordingly, a contact between the first coupling portion and the second coupling portion can be stably maintained.

In addition, surfaces of the first coupling portion, the second coupling portion, and the connecting portion facing the handle of the main body are provided with a slip prevention portion, respectively. The slip prevention portion is made of a material capable of increasing a frictional force, or is provided in the form of unevenness. Thus, a frictional force generated at a contact portion between the handle and the conversion member can be increased. Accordingly, the main body and the conversion member can be securely coupled to each other.

Further, in case the main body is located at a lower position, an extension handle may be provided. The extension handle is detachably coupled to the pipe to be located at the uppermost part or highest position of the electric cleaner. The user can perform cleaning by gripping the extension handle. Accordingly, even when the main body is located at the lower position, the user can use the electric cleaner by gripping the extension handle. This may result in improving user convenience.

In addition, an angle between a first portion and a second portion, gripped by the user, of the extension handle is similar to an angle between a first extended portion and a second extended portion, gripped by the user, of the handle of the main body. In one embodiment, the angles may be equal. Thus, the user may feel a similar sense of grip when gripping the extension handle and when grasping the handle of the main body. Accordingly, it will give the same or similar sense of grip to the user, thereby reducing aversion to adding a new member.

In addition, the intake port, the main body, and the conversion member are electrically connected to one another. Thus, the user can apply power and a control signal desired by manipulating the main body. Further, the conversion member, the pipe, and the extension handle are electrically connected to each other. The extension handle is provided with an extension switch. Power and a control signal applied to the extension switch may be transmitted to the main body and the intake port by this electric connection. Thus, the user can apply power and a control signal for controlling the electric cleaner using the extension switch included in the extension handle. This may result in improving user convenience.

In one embodiment, the intake port is provided with a joint unit. The joint unit includes an insertion portion provided at an intake connector and an accommodating portion provided at a housing. When the intake connector is rotated toward the housing, the insertion portion is inserted into and detachably coupled to the accommodation portion.

At this time, an insertion protrusion of the insertion portion is fittingly coupled to a space portion of the accommodating portion. Accordingly, the insertion portion and the accommodating portion are not separated from each other unless an external force is applied. Once the insertion portion and the accommodating portion are coupled to each other, the housing and the intake connector may be disposed perpendicular to each other. Accordingly, when the insertion portion and the accommodating portion are coupled to each other, the electric cleaner may maintain a self-standing state without a separate mounting member.

In one embodiment, the electric cleaner can be mounted or placed on a stand holder. The stand holder includes a charging unit (or charger) and a support for adjusting a height of the charging unit. The support may be implemented as a rail, or the like, allowing adjustment in length.

Accordingly, when the main body is located at a lower position, the length of the support can be reduced, allowing a position of the charging unit to be lower corresponding to the position of the main body. In addition, when the main body is located at an upper position, the length of the support can be increased, allowing the position of the charging unit to be higher corresponding to the position of the main body. Therefore, the electric cleaner may be placed on the stand holder regardless of the relative position of the main body. This may result in improving user convenience.

In certain examples, a conversion member for use with a cleaner may comprise: a collar configured to selectively receive an end of a pipe, wherein the pipe, when received in the collar, extends in a first direction from collar; and a clamp connected to the collar in a second direction opposite to the first direction, wherein the clamp includes: a first wall connected to the collar; and at least one second wall rotatably connected to the first wall, and wherein the first wall and the at least one second wall form a space for receiving the cleaner.

Each of the first wall and the at least one second wall may include a concave surface. The at least one second wall may include a pair of second walls, and the clamp may include: a first hinge coupled respectively to the first wall and a side of one of the pair of second walls; and a second hinge coupled respectively to a second side of the first wall and a side of another one of the pair of second walls.

The clamp may include a slip prevention layer provided on at least one inner surface of the at least one second wall. The clamp may include another slip prevention layer provided on an inner surface of the first wall.

The at least one second wall may include a pair of second walls, the conversion member may further comprise: a latch rotatably provided at one of the pair of second walls; and a catch provided at another one of the pair of second walls, the latch and the catch may be are configured to be detachably coupled to each other.

The clamp may be configured to receive a handle of the cleaner. The at least one second wall may include a pair of second walls, and the clamp may further include a slot that extends through respective regions of the pair of second walls.

In certain examples, a vacuum cleaner may comprise: a main body having a dust container; an intake port detachably coupled to a first side of the main body and communicating with the dust container; an adapter detachably coupled to a handle provided at a second side of the main body; and a pipe coupled to the adapter, wherein the adapter includes: a collar configured to be coupled to a first end of the pipe; and a clamp connected to the collar, and wherein the clamp includes: a first wall connected to the collar; and at least one second wall rotatably coupled to the first wall, and wherein the first wall and the at least one second wall form a space for receiving the handle.

Each of the first wall and the at least one second wall includes a concave surface facing the space for receiving the handle. The at least one second wall may include a pair of second walls, and the clamp may include: a first hinge coupled to one of the pair of second walls and a first side of the first wall; and a second hinge coupled to another one of the pair of second walls and a second side of the first wall. The clamp may include a slip prevention layer provided on a surface of at least one of the first wall or the at least one second wall.

The at least one second wall may include a pair of second walls, and the vacuum cleaner may further comprise: a latch rotatably coupled to one of the pair of second walls; and a catch provided at another one of the pair of second walls, wherein the latch and the catch are configured to be detachably coupled to each other.

The vacuum cleaner may further comprise an extension handle detachably coupled to a second end of the pipe, wherein the extension handle includes a grip located opposite to the pipe, and wherein the grip includes: a first grip portion extending away from the pipe by a predetermined length; and a second grip portion connected to the first grip portion and extending at a first angle with respect to the first grip portion.

The intake port may be electrically connected to the main body, the adapter, when coupled to the main body, may be electrically connected to the main body, the pipe, when coupled to the adapter, may electrically connected to the adapter, and the extension handle, when coupled to the pipe, may be electrically connected to the pipe.

The handle may include: a first handle segment extending from the main body by a predetermined length; a second handle segment that is connected to the first handle segment and extends at a second angle with respect to the first handle segment; and a third handle segment connected to the second handle segment and extending at a third angle with respect to the second handle segment.

The first angle between the first grip portion and the second grip portion of the extension handle may be within a range of 90% to 110% of the second angle between the first handle segment and the second handle segment that of the handle. The first angle between the first grip portion and the second grip portion of the extension handle may be equal to the second angle between the first extended handle segment and the second extended handle segment of the handle. The first grip portion may include an extension switch that is configured to provide a control signal to at least one of the main body or the intake port.

In another example, a cleaner may comprise a vacuum cleaner having a cleaner head, a battery, a dust container, and a first handle attached to at least one of the dust container or the battery; an adapter configured to clamp to the first handle; a wand configured to be coupled to the adapter; and a second handle configured to be coupled to the wand.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A conversion member for use with a cleaner, the conversion member comprising:

a collar configured to selectively receive an end of a pipe, wherein the pipe, when received in the collar, extends in a first direction from collar; and a clamp connected to the collar in a second direction opposite to the first direction, wherein the clamp includes:

a first wall connected to the collar; and at least one second wall rotatably connected to the first wall, wherein the first wall and the at least one second wall form a space for receiving the cleaner, wherein the at least one second wall includes a pair of second walls, wherein the conversion member further includes:

a latch rotatably provided at one of the pair of second walls; and a catch provided at another one of the pair of second walls, wherein the latch and the catch are configured to be detachably coupled to each other, wherein a predetermined space is formed inside the latch, and the catch is detachably inserted into the space, wherein the at least one second wall includes a pair of second walls, wherein the clamp includes:

a first hinge rotatably coupled respectively to a one end of the first wall and a side end of one of the pair of second walls, and a second hinge rotatably coupled respectively to another end of the first wall and a side end of another one of the pair of second walls, and wherein a penetrating portion penetrates through one side of the pair of the second walls, respectively.

2. The conversion member of claim 1, wherein each of the first wall and the at least one second wall includes a concave surface.

3. The conversion member of claim 1, wherein the clamp includes a slip prevention layer provided on at least one inner surface of the at least one second wall.

4. The conversion member of claim 3, wherein the clamp includes another slip prevention layer provided on an inner surface of the first wall.

5. The conversion member of claim 1, wherein the clamp is configured to receive a handle of the cleaner.

6. The conversion member of claim 1, wherein the at least one second wall includes a pair of second walls, and the clamp further includes a slot that extends through respective regions of the pair of second walls.

7. A vacuum cleaner, comprising:

a main body having a dust container;

an intake port detachably coupled to a first side of the main body and communicating with the dust container;

an adapter detachably coupled to a handle provided at a second side of the main body; and a pipe coupled to the adapter, wherein the adapter includes: a collar configured to be coupled to a first end of the pipe; and a clamp connected to the collar, wherein the clamp includes:

a first wall connected to the collar; and at least one second wall rotatably coupled to the first wall, wherein the first wall and the at least one second wall form a space for receiving the handle, wherein the at least one second wall includes a pair of second walls, wherein the vacuum cleaner further comprises:

a latch rotatably coupled to one of the pair of second walls; and a catch provided at another one of the pair of second walls, wherein the latch and the catch are configured to be detachably coupled to each other, wherein a predetermined space is formed inside the latch, and the catch is detachably inserted into the space, wherein the at least one second wall includes a pair of second walls, wherein the clamp includes:

a first hinge rotatably coupled respectively to a one end of the first wall and a side end of one of the pair of second walls; and a second hinge rotatably coupled respectively to another end of the first wall and a side end of another one of the pair of second walls, and wherein a penetrating portion penetrate through one side of the pair of the second walls, respectively.

8. The vacuum cleaner of claim 7, wherein each of the first wall and at least one second wall includes a concave surface facing the space for receiving the handle.

9. The vacuum cleaner of claim 7, wherein the clamp includes a slip prevention layer provided on a surface of at least one of the first wall or the at least one second wall.

10. The vacuum cleaner of claim 7, further comprising an extension handle detachably coupled to a second end of the pipe, wherein the extension handle includes a grip located opposite to the pipe, and wherein the grip includes:

a first grip portion extending away from the pipe by a predetermined length; and a second grip portion connected to the first grip portion and extending at a first angle with respect to the first grip portion.

11. The vacuum cleaner of claim 10, wherein:

the intake port is electrically connected to the main body, the adapter, when coupled to the main body, is electrically connected to the main body, the pipe, when coupled to the adapter, is electrically connected to the adapter, and the extension handle, when coupled to the pipe, is electrically connected to the pipe.

12. The vacuum cleaner of claim 10, wherein the handle includes:

a first handle segment extending from the main body by a predetermined length;

a second handle segment that is connected to the first handle segment and extends at a second angle with respect to the first handle segment; and a third handle segment connected to the second handle segment and extending at a third angle with respect to the second handle segment.

13. The vacuum cleaner of claim 12, wherein the first angle between the first grip portion and the second grip portion of the extension handle is within a range of 90% to 110% of the second angle between the first handle segment and the second handle segment that of the handle.

14. The vacuum cleaner of claim 12, wherein the first angle between the first grip portion and the second grip portion of the extension handle is equal to the second angle between the first extended handle segment and the second extended handle segment of the handle.

15. The vacuum cleaner of claim 10, wherein the first grip portion includes an extension switch that is configured to provide a control signal to at least one of the main body or the intake port.

16. A cleaner, comprising:

a vacuum cleaner according to claim 7, and having a cleaner head, a battery, a dust container, and a first handle attached to at least one of the dust container or the battery, the adapter being configured to clamp to the first handle the pipe being configured to be coupled to the adapter; and a second handle configured to be coupled to the pipe.

* * * * *